United States Patent [19]

Kaneda et al.

[11] Patent Number: 4,536,887

[45] Date of Patent: Aug. 20, 1985

[54] MICROPHONE-ARRAY APPARATUS AND METHOD FOR EXTRACTING DESIRED SIGNAL

[75] Inventors: Yutaka Kaneda, Tanashi; Juro Ohga, Kamakura, both of Japan

[73] Assignee: Nippon Telegraph & Telephone Public Corporation, Tokyo, Japan

[21] Appl. No.: 539,891

[22] Filed: Oct. 7, 1983

[30] Foreign Application Priority Data

Oct. 18, 1982 [JP] Japan ..... 57-182355
Aug. 15, 1983 [JP] Japan ..... 58-149500

[51] Int. Cl.[3] ..... H04R 1/22

[52] U.S. Cl. ..... 381/92; 179/121 D; 381/58; 381/94

[58] Field of Search ..... 381/92, 56, 58, 59, 381/94; 179/121 D, 121 R, 81 B, 100 L

[56] References Cited

U.S. PATENT DOCUMENTS

| | | | |
|---|---|---|---|
| 3,973,089 | 8/1976 | Puckette | 179/170 NC |
| 4,122,303 | 10/1978 | Chaplin et al. | 381/71 |
| 4,306,113 | 12/1981 | Morton | 381/58 |
| 4,461,025 | 7/1974 | Franklin | 381/94 |

*Primary Examiner*—Gene Z. Rubinson
*Assistant Examiner*—Danita R. Byrd
*Attorney, Agent, or Firm*—Pollock, Vande Sande and Priddy

[57] ABSTRACT

An acoustic signal is received by a plurality of microphone elements and their outputs are delayed by delay means and weighted and summed up by weighted summation means, obtaining a noise-reduced output. A fictitious desired signal is electrically generated and the weighting values of the weighted summation means is determined based on the fictitious desired signal and the outputs of the microphone elements when receiving substantially only noises.

29 Claims, 32 Drawing Figures

MICROPHONE-ARRAY APPARATUS AND METHOD FOR EXTRACTING DESIRED SIGNAL

BACKGROUND OF THE INVENTION

The present invention relates to a microphone-array apparatus which selectively receives an acoustic signal through use of a plurality of microphone elements and a method for extracting a desired signal with the apparatus.

When a desired acoustic signal (hereinafter referred to as the desired signal) is received by a microphone, undesired acoustic signals, such as machinery noises, unnecessary voices and so on (hereinafter referred to as the noise) are simultaneously received, causing a reduction of the SN ratio, the occurrence of howling and so forth in many cases. The solution of this phenomenon has been an important problem in a loudspeaking telephone system, a PA (Public Address) system and the like. To settle this problem, a directional microphone has been employed in many cases. In practice, however, this method poses many problems, such as limitations on the talker's position and noise source positions according to the direction of the microphone because of its fixed directivity pattern. In recent years, a linear microphone-array has been employed with regard to achieving sharp directivity (R. L. Wallance et al, U.S. Pat. No. 4,311,874, issued on Jan. 19, 1982). With this method, however, since the design theory is limited specifically to the plane wave, the operation does not agree with the theory when sound waves are spherical waves as in many actual cases and, in addition, a microphone-array as long as one to several meters is needed.

SUMMARY OF THE INVENTION

It is therefore an object of the present invention to provide microphone-array apparatus which can be constructed on a small scale and permits adaptive selection of the desired signal for varied positions of a desired signal and noise sources.

According to the present invention, outputs of a plurality of microphone elements are delayed by first delay means for respectively different periods of time, and the delayed signals are each weighted and summed up by weighted summation means, thereafter being output therefrom. A fictitious desired signal (hereinafter referred to simply as the FD signal) is electrically generated, and the FD signal and the output of each microphone element are added. The added outputs are similarly delayed by second delay means. By using these delayed outputs from the second delay means and the FD signal, weighting values for the above weighted summation are determined in such a manner as to minimize a predetermined measure when the microphone outputs contain substantially only noise components to be suppressed. As a result of this, the output of the weighted summation contains the noise-reduced desired signal. Further, the degradation of the frequency response to the desired signal is detected and is compared with a threshold value and, based on the comparison result, the level of the FD signal is controlled so that the output noise power level is minimized under the condition that the degradation is made smaller than the predetermined threshold value.

DESCRIPTION OF THE PREFERRED EMBODIMENTS

Figure 1:
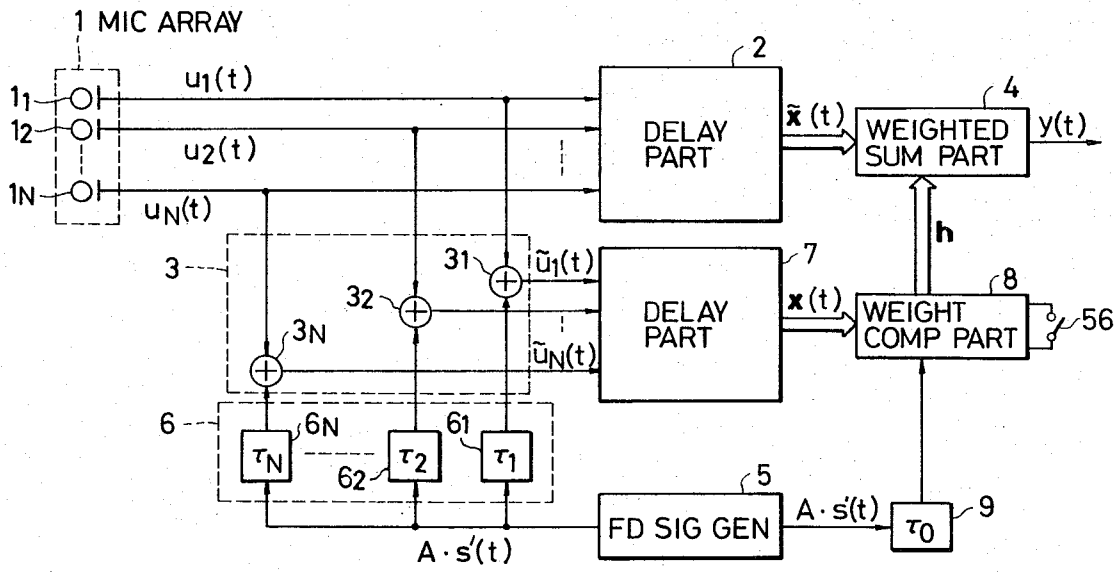
FIG. 1 is a block diagram illustrating an embodiment of this invention apparatus.

FIG. 1 illustrates an embodiment of the present invention. N omnidirectional or directional microphone elements $1_1$ to $1_N$ are spatially arranged to constitute a microphone-array 1. The microphone-array 1 is connected to a delay part 2 and an addition part 3 comprised of adders $3_1$ to $3_N$. The output side of the delay part 2 is connected to a weighted summation part 4. An FD (i.e. Fictitious Desired) signal generator 5 is provided, the output side of which is connected to an FD signal delay part 6 which is made up of variable delay elements $6_1$ to $6_N$, and the output side of the FD signal delay part 6 is connected to the addition part 3. The output side of the addition part 3 is connected to a delay part 7, the output side of which is, in turn, connected to a weighting value computing part 8. To the weighting value computing part 8 is connected the output side of the FD signal generator 5 via a delay element 9, and the weighting value computing part 8 is connected to a set input side of the weighted summation part 4.

Figure 2:
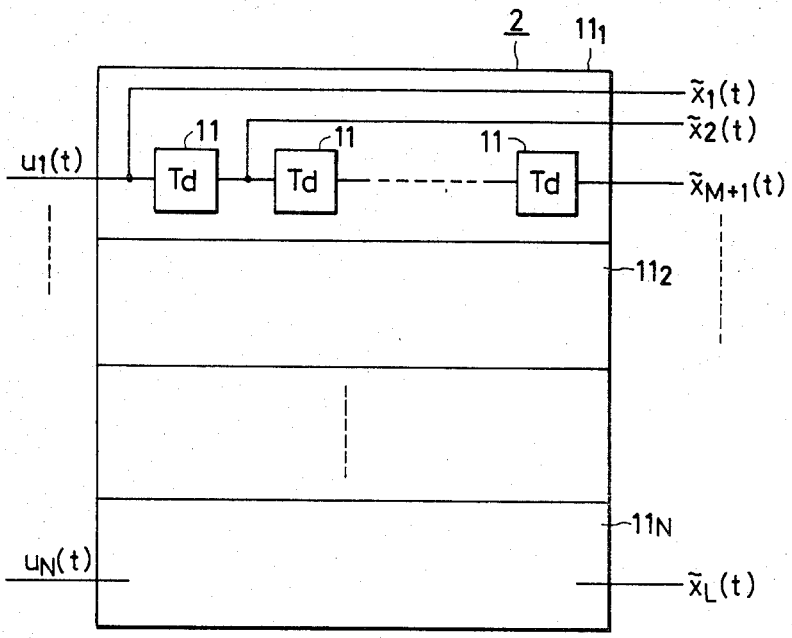
FIG. 2 is a schematic diagram showing an example of a delay part 2 used in FIG. 1.

A description will be given first of the basic operation of this embodiment. In the microphone-array 1 signals $u_1(t)$ to $u_N(t)$, each composed of a desired signal and noises are received by the N microphone elements $1_1$ to $1_N$. These received signals are provided to the delay part 2. As shown in FIG. 2, the delay part 2 comprises N delay units $11_1$ to $11_N$, each formed by a series connection of M delay elements 11 of a delay time $T_d$. Each delay unit outputs a total of M+1 signals, i.e. the input signal applied thereto and output signals of the respective M delay elements 11. Accordingly, the delay part 2 provides L (L =N×(M+1)) signals $\times_1(t)$ to $_L(t)$ for the N input signals $u_1(t)$ to $u_N(t)$.

In the weighted summation part 4 the output signals $\times_1(t)$ to $_L(t)$ of the delay part 2 are subjected to weighted summation. This weighted summation is expressed by the following equation using weighting values $h_1$ to $h_L$:

$$y(t) = h^T \cdot \tilde{X}(t) = \sum_{j=1}^{L} h_j \cdot \tilde{x}_j(t) \quad (1)$$

-continued $$\text{where } h = \begin{pmatrix} h_1 \\ h_2 \\ \cdot \\ \cdot \\ \cdot \\ h_L \end{pmatrix} \quad \tilde{X}(t) = \begin{pmatrix} \tilde{x}_1(t) \\ \tilde{x}_2(t) \\ \cdot \\ \cdot \\ \cdot \\ \tilde{x}_L(t) \end{pmatrix}$$

and where T denotes a transposed matrix. As a result of this weighted summation, the output y(t) of this apparatus is obtained. This weighted summation corresponds to the addition of the receiving sound signals $u_1(t)$ to $u_N(t)$ after subjecting each of them to filtering with an impulse response given by $$h_i(t) = \sum_{m=1}^{M+1} h_i(m) \cdot \delta(t - (m-1)T_d) \quad (2)$$

where $h_1(m) = h_{(i-1)(M+1)+m}$.

Therefore, the output y(t) can be expressed as follows:

$$y(t) = \sum_{i=1}^{N} h_i(t) \otimes u_i(t) \quad (3)$$

where $\otimes$ denotes a convolution. Further, this filtering is equivalent to FIR filtering in a digital system.

By computing the weighting value h through the following method and applying the computed result to Eq. (1), the noise-reduced output y(t) which has extracted therein the desired signal can be obtained.

For the computation of the weighting value, the following two requirements are set:

Requirement-I:

Arriving time differences of the desired signal among the microphone elements are preknown.

Requirement-II:

The desired signal has at least one silent period, during which only noises to be reduced are received.

Figure 3:
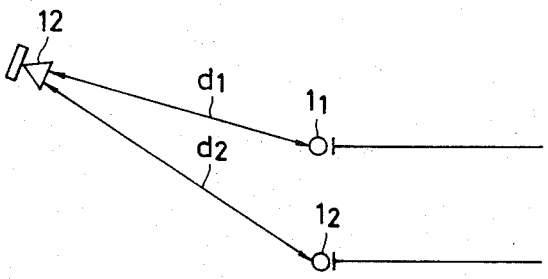
FIG. 3 is a diagram explanatory of the desired signal arriving time difference.

The arriving time difference mentioned above in Requirement-I is the difference in the time of arrival of the desired signal (sound wave) at the microphone elements which is caused by the spatial arrangement of the microphone elements. For example, in the case where the microphone elements $1_1$ and $1_2$ are disposed at distances $d_1$ and $d_2$ from a desired signal source 12 as shown in FIG. 3, the arriving time difference $\tau$ is the quantity expressed by the following equation:

$$\tau = (d_2 - d_1)/c \quad (4)$$

where c is the sound velocity. Accordingly, if the direction of arrival of the desired signal is preknown when its sound wave can be regarded as a plane wave, or if the position of the desired signal source is preknown when the sound wave of the desired signal can be regarded as a spherical wave, then the condition of Requirement-I is satisfied. Usually, a speech signal which has silent periods is the desired signal, so that the condition of Requirement-II is usually satisfied.

Now, the computation of the weighting value is carried out by the following procedure under the condition that fulfills Requirement-II, that is, when the desired signal is not present and the N microphone elements are receiving only the noises to be reduced.

At first, in FIG. 1, an FD signal A·s'(t) (where s'(t) represents a signal of unit power and A is a constant representing its amplitude level) is generated by the FD signal generator 5. Then the signal A·s'(t) is applied to the FD signal delay part 6, and its output signals are added to the noises received by the N microphone elements $\mathbf{1}_1$ to $\mathbf{1}_N$ in the addition part 3. In the FD signal delay part 6, the signal A·s'(t) is delayed for N delay times $\tau_1$ to $\tau_N$ by the N variable delay elements $\mathbf{6}_1$ to $\mathbf{6}_N$, producing N delayed FD signals $A\cdot s'(t-\tau_1)$ to $A\cdot s'(t-\tau_N)$. The relationships among the values of the delay times $\tau_1$ to $\tau_n$ satisfy the relationships among the actual arriving time differences defined as preknown in Requirement-I. Accordingly, to add the delayed FD signals $A\cdot s'(t-\tau_1)$ to $A\cdot s'(t-\tau_N)$ and the microphone outputs $u_1(t)$ to $u_N(t)$ containing only the noises according to Requirement-II, in the addition part 3, corresponds to the simulation of the state of receiving an FD signal from the actual desired signal source by the N microphone elements $\mathbf{1}_1$ to $\mathbf{1}_N$, along with the noises. In this case, however, when $\tau_1=\tau_2=\ldots=\tau_N$, the delay part 6 can be omitted.

Next, signals $\tilde{u}_1(t)$ to $\tilde{u}_N(t)$ obtained by the addition of the received noise signals and the delayed FD signals are provided to the delay part 7 of the same arrangement as the delay part 2, obtaining L signals $x_1(t)$ to $x_L(t)$ represented by X(t). At this time, using the signals $x_1(t)$ to $x_L(t)$, the weighting values $h_1$ to $h_L$, and the FD signal $A\cdot s'(t-\tau_0)$ which has been given by the delay element 9 a suitable delay $\tau_0$ ($\min(\tau_1, \ldots \tau_N) \leqq \tau_0 \leqq \max(\tau_1, \ldots \tau_N)+M\times T_d$), a mean square error E is defined as follows:

$$E = \overline{\left| As'(t-\tau_0) - \sum_{j=1}^{L} h_j x_j(t) \right|^2} \tag{5}$$

where the line over the expression means time averaging. Then, the weighting value h is determined based on the least mean square principle in a manner to minimize the mean square error E. By partially differentiating Eq. (5) in respect of $h_i$ and solving the equation given by the resulting formula set to 0, it is possible to obtain the weighting value h that minimizes the mean square error E as follows:

$$\begin{aligned} \frac{\partial E}{\partial h} &= \frac{\partial}{\partial h} \overline{|As'(t-\tau_0) - h^T X(t)|^2} \\ &= \frac{\partial}{\partial h}\left\{ \overline{[As'(t-\tau_0)]^2} - 2h^T \overline{As'(t-\tau_0)X(t)} + h^T c_x h \right\} \\ &= -2\overline{As'(t-\tau_0)X(t)} + 2c_x h = 0 \end{aligned} \tag{6}$$

where $$\frac{\partial E}{\partial h} = \begin{pmatrix} \frac{\partial E}{\partial h_1} \\ \frac{\partial E}{\partial h_2} \\ \cdot \\ \cdot \\ \cdot \\ \frac{\partial E}{\partial h_L} \end{pmatrix} \quad h = \begin{pmatrix} h_1 \\ h_2 \\ \cdot \\ \cdot \\ \cdot \\ h_L \end{pmatrix} \quad X(t) = \begin{pmatrix} x_1(t) \\ x_2(t) \\ \cdot \\ \cdot \\ \cdot \\ x_L(t) \end{pmatrix}$$

-continued $$c_x = \begin{pmatrix} \overline{x_1(t)\cdot x_1(t)}, & \overline{x_1(t)\cdot x_2(t)}, & \ldots, & \overline{x_1(t)\cdot x_L(t)} \\ \overline{x_2(t)\cdot x_1(t)}, & \overline{x_2(t)\cdot x_2(t)}, & \ldots, & \overline{x_2(t)\cdot x_L(t)} \\ \cdot & & \ddots & \cdot \\ \cdot & & & \cdot \\ \cdot & & & \cdot \\ \overline{x_L(t)\cdot x_1(t)}, & \ldots & & \overline{x_L(t)\cdot x_L(t)} \end{pmatrix}$$

Therefore, $$h = c_x^{-1}\,\overline{As'(t-\tau_0)X(t)} \tag{7}$$

In practice, the necessary time for the time averaging is about 0.5 sec. Therefore, for the effective operation of the apparatus it would be enough if the desired signal has at least one silent period longer than 0.5 sec. In this way, the weighting value h expressed by Eq. (7) is calculated in the weighting value computing part 8 through using the correlation matrix $C_x$ of each $x_i(t)$ (where $i=1, \ldots L$), and the computed weighting value h is supplied to the weighted summation part 4. To minimize the mean square error E of Eq. (5) means to reduce the noise components in the signal $\tilde{X}(t)$. The output signal X(t) of delay part 2 contains the same noise components as those in the signal X(t). Therefore, the weighted summation in the weighted summation part 4 using the weighting value h of Eq. (7) reduces the noise components in the signal X(t). Thus the output y(t) can be obtained in which the noise components have been reduced.

Here, if it were possible to use, as the FD signal, exactly the same signal as the desired signal actually received without noises, then the obtained weighting value would be an optimum value for the actual desired signal in the sense of the minimum mean square error. In such a case, it would be an optimum solution to output the FD signal itself; however, this is apparently impracticable. Further, if a signal similar to the actual desired signal, for example, an artificial voice for a human voice, is used as the FD signal, then it is possible to obtain a value close to the optimum solution in the sense of the minimum mean square error. But, in the case where the frequency power spectrum of the actual desired signal is not flat, the optimization using a FD signal of the same power spectrum for minimizing the square error is performed mainly in connection with the frequency component of large power. As a result of this, the frequency response of this apparatus for the desired signal is flat in the frequency band in which the power of the desired signal is large, but it does not always become flat in the frequency band in which the power of the desired signal is small.

A method for improving this is to use, as the FD signal, a signal having a power spectrum which is flat in a desired frequency band (for example, band-limited white noise). This permits uniform optimization for respective frequency components, providing the desired signal with flatter frequency response. Also it is possible to employ, as the FD signal, colored noise obtained by weighting such band-limited white noise according to the degree of contribution to voice articulation, for instance, colored noise of increased power of the frequency component in the vicinity of 1000 Hz. The band-limited white noise can be produced by employing an ordinary white noise generator and, further, it may also be prestored in a memory and read out therefrom as required. The colored noise may also be similarly prestored in a memory and read out therefrom.

Figure 4:
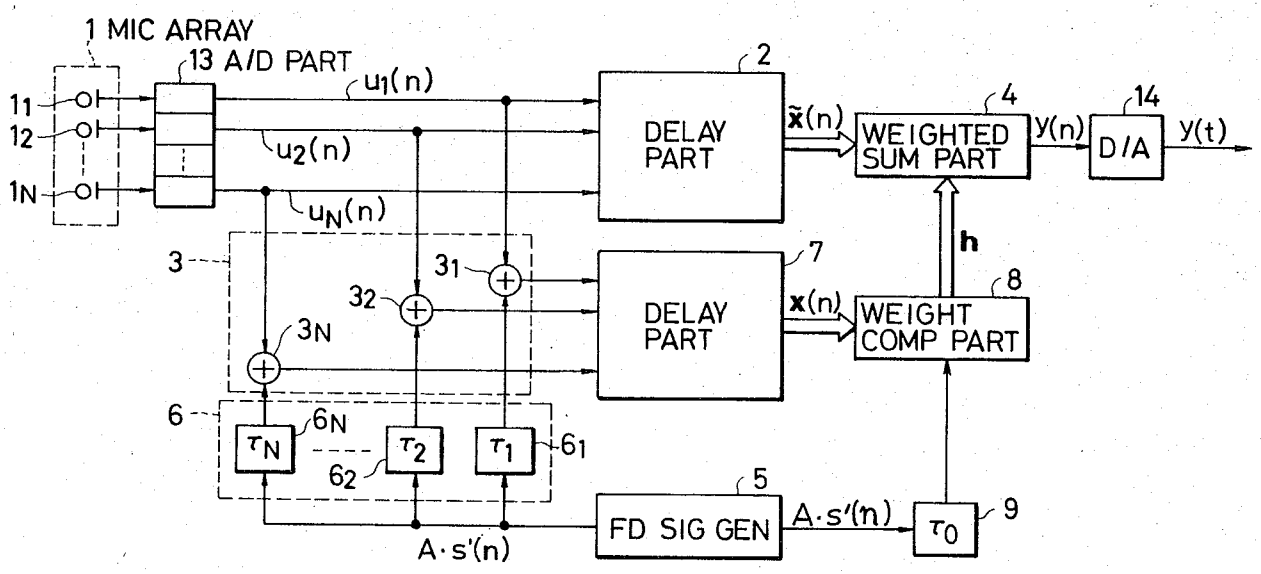
FIG. 4 is a block diagram illustrating an embodiment of this invention apparatus implemented as a digital system.

One method for implementing the present invention described above is to constitute its entire system in digital form, such as shown in FIG. 4. In FIG. 4 the parts corresponding to those in FIG. 1 are identified by the same reference numerals. The outputs of the microphone elements $1_1$ to $1_N$ are converted into digital signals by an A/D conversion part 13 which is provided with anti-aliasing filters and A/D converters. The digital signals thus obtained are provided to the delay part 2 and the addition part 3. The output of the weighted summation part 4 is converted by a D/A converter 14 into an analog signal for output.

Figure 5:
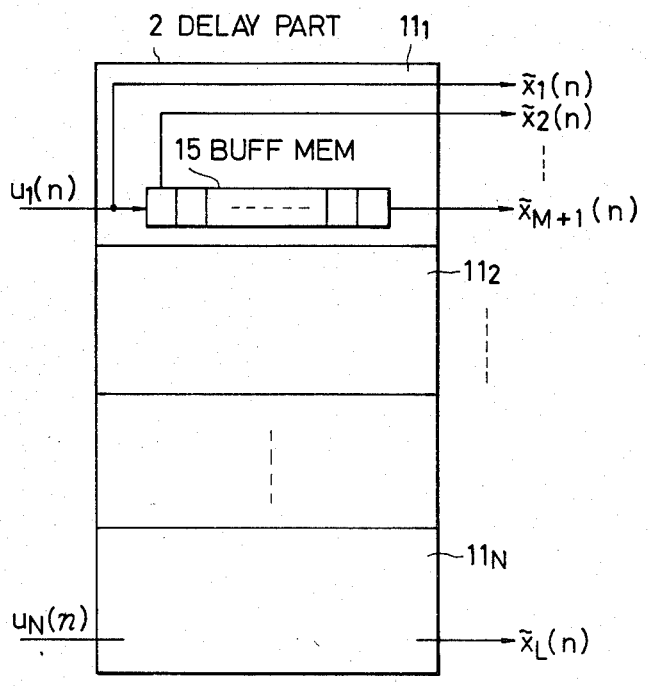
FIG. 5 is a schematic diagram showing an example of the delay part 2 in the case of the apparatus of the present invention being implemented as a digital system.
Figure 6:
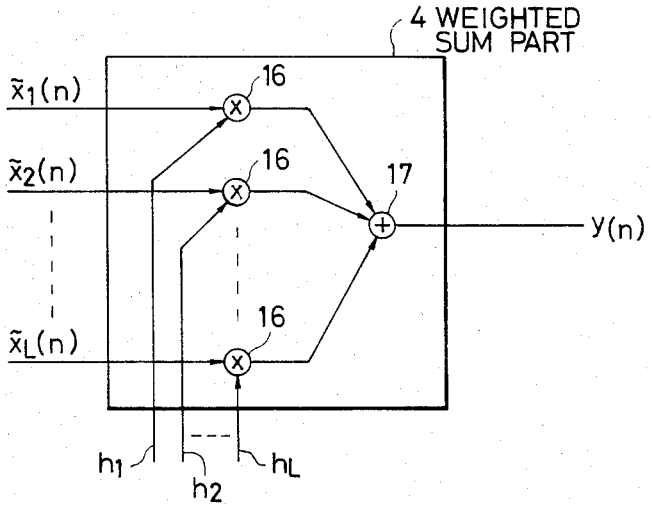
FIG. 6 is a schematic diagram showing an example of a weighted summation part 4 in the case of the apparatus of the present invention being implemented as a digital system.

FIG. 5 illustrates a specific example of the delay parts 2 and 7. The delay unit $11_1$ is comprised of an M-stage buffer memory 15, from each stage of which is led out an output. The other delay units are also identical in construction to the delay unit $11_1$. The delay time $T_d$ of each stage is selected equal to the sampling period of the abovesaid A/D converter. The delay unit $11_1$ may also be constructed as an M-stage shift register. In the weighted summation part 4, as shown in FIG. 6, the outputs $\bar{x}_1(n)$ to $\bar{x}_L(n)$ of the delay parts 2 are respectively multiplied by weighting values $h_1$ to $h_L$ in individual multipliers 16, and the multiplied outputs are added by an adder 17. In FIG. 4 the weighting value computing part 8 is a processor which possesses an arithmetic function and which obtains the weighting value h by directly calculating Eq. (7).

For the computation of the weighting value h, it is possible to use, other than the aforementioned method, various recursive algorithms employed in echo canceller and automatic equalizer technologies. In the case of utilizing the recursive algorithm, care should be taken of the convergence time of the algorithm, but the weighting value h can be obtained with fewer calculations and memories than in the case of directly calculating Eq. (7).

Figure 7:
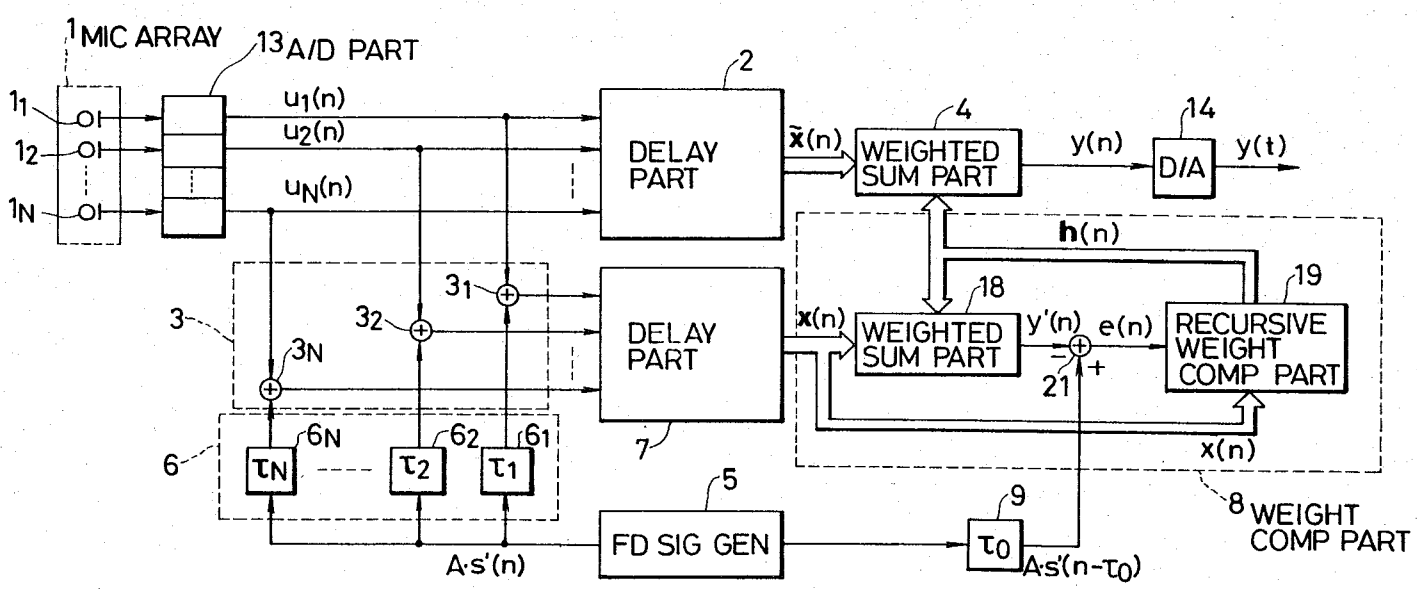
FIG. 7 is a block diagram illustrating an embodiment in which a method of determining the weighting values in the apparatus of the present invention by a recursive algorithm is implemented by a digital system.

FIG. 7 shows the arrangement for obtaining the weighting value through utilization of the recursive algorithm. In FIG. 7 the parts corresponding to those in FIG. 4 are identified by the same reference numerals. The output of the delay part 7 is provided to a weighted summation part 18 of the same construction as the weighted summation part 4 and, at the same time, it is applied to a recursive weighting value computing part 19. The output of the weighted summation part 18 is subtracted by an adder 21 from the output of the delay element 9, and the subtracted output is applied to the recursive weighting value computing part 19 wherein a weighting value is computed. The thus obtained weighting value is supplied as the weighting value h to the weighted summation parts 4 and 18.

As the recursive algorithm that employs the mean square error as a measure, use can be made of a method known as the LMS algorithm. With this algorithm, the weighting value $h_{(n)}$ (where n is a parameter representing sampling time) at every sampling time is calculated by the following equation in the recursive weighting value computing part 19:

$$h(n) = h(n-1) + 2 \cdot \alpha X(n-1) \cdot e(n-1)/[X^T(n-1) \cdot X(n-1)] \text{ where } e(n-1) = As'(n-\tau_0) - y'(n-1) \text{ and } y'(n-1) = h^T(n-1) \cdot X(n-1). \quad (8)$$

Another method for implementing the present invention is to constitute the entire system in analog form. An example of such an arrangement is shown in FIG. 1, and specific examples of the respective parts are as follows: The arrangement of the delay parts 2 and 7 is as shown in FIG. 2, in which each delay element is formed by a BBD, CCD or like analog delay element. The weighted summation part 4 is similar in construction to that employed in the case of the digital system shown in FIG. 6. That is, the multipliers 16 in FIG. 6 are replaced with analog multipliers, and the adder 17 is replaced with an analog adder. In the case of computing the weighting value in the analog system, it is difficult to conduct calculations, such as the computation of an inverse matrix. Therefore, the computation of the weighting value in the part 8 of FIG. 1 is effected by using a recursive algorithm in the circuit arrangement shown in FIG. 8.

Figure 8:
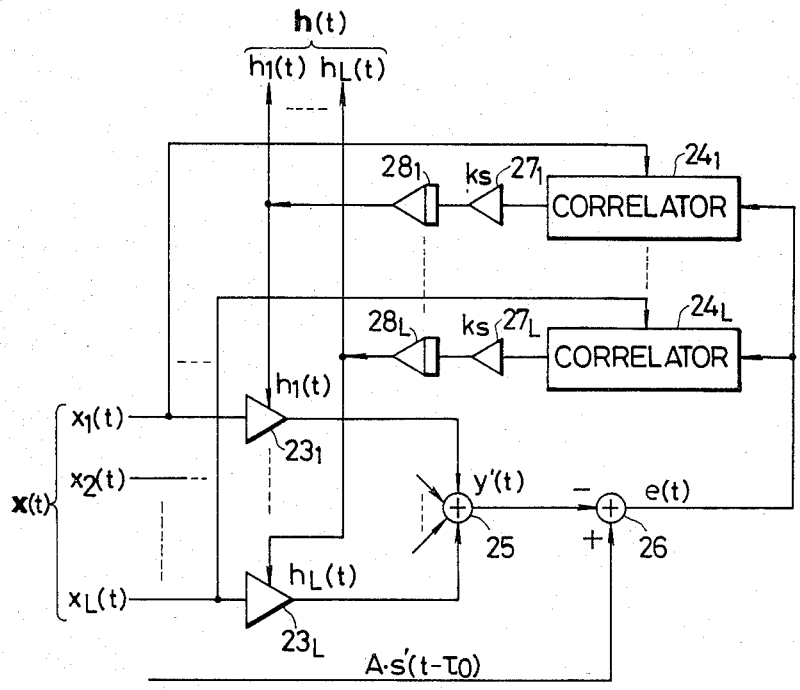
FIG. 8 is a schematic diagram illustrating a weighting value computing part 8 being implemented by an analog system in the apparatus of the present invention.

In FIG. 8 the output x(t) of the delay part 7 is supplied to L analog multipliers $23_1$–$23_L$ and, at the same time, is supplied to L analog correlators $24_1$–$24_L$ as well. The outputs of the L analog multipliers 23 are added by an analog adder 25, and its output is subtracted from the output of the delay element 9 by an adder 26, the subtracted output of which is applied to each of the correlators $24_1$–$24_L$. The outputs of the correlators $24_1$–$24_L$ are respectively provided via analog multipliers $27_1$–$27_L$ to L integrators $28_1$–$28_L$. From the integrators $28_1$–$28_L$ are obtained weighting values, which are supplied to the multipliers $23_1$–$23_L$.

This circuit arrangement satisfies the following equation that is a gradient equation of the weighting value in a continuous system:

$$\frac{dh_i(t)}{dt} = \overline{k_s x_i(t) \cdot e(t)}, \text{ where } i = 1, 2, \ldots, L$$

Now, in order that the apparatus of the present invention may perform the desired operation as described previously, it is necessary to satisfy the following two aforementioned requirements:

Requirement-I

The arriving time differences of the desired signal among the microphone elements are preknown.

Requirement-II

The desired signal has a silent period, during which only the noises to be reduced are received.

Next, a description will be given of additional functions for the apparatus of the present invention to automatically fulfill the above requirements. In the case where the noises are lower in level than the desired signal, thus allowing a high SN ratio, or where the noisy sound has a silent period allowing a high SN ratio, Requirement-I will be satisfied by the additional provision of such arriving time difference detecting means as exemplified hereinbelow. At first, the cross correlation functions among the microphone element outputs $u_1(t)$ to $u_N(t)$ are calculated. Then a value $\tau_{Mij}$ of $\tau$ is obtained which maximizes the cross-correlation function $\phi_{sij}(\tau)$ between the microphone element outputs $u_i(t)$ and $u_j(t)$. The value $\tau_{Mij}$ can be regarded as the arriving time difference between the desired signals received by the microphone elements $1_i$ and $1_j$. In the case of detecting the arriving time difference $\tau_{Mij}$ from digitized signals $u_i(n)$ and $u_j(n)$ (where $n = \ldots, -1, 0, 1, \ldots$), it is necessary for obtaining the value $\tau_{Mij}$ to raise the sampling frequency sufficiently high, or to obtain the arriving time difference after applying an interpolation method to the cross-correlation functions obtained at a low sampling frequency. As a result of this, Requirement-I is satisfied.

Figure 10:
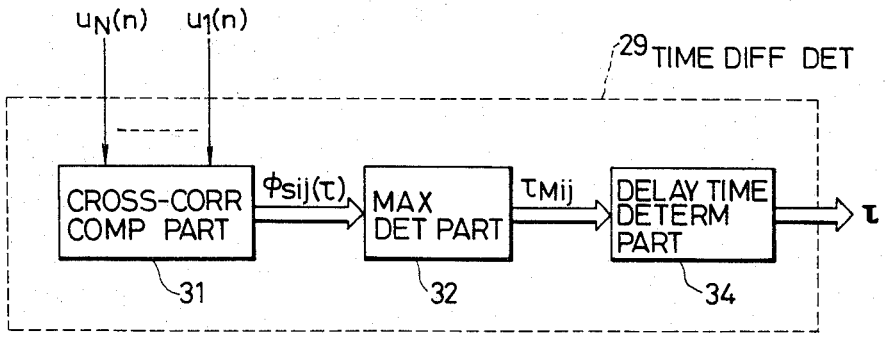
FIG. 10 is a block diagram showing an example of the desired signal arriving time difference detecting means 29.
Figure 9:
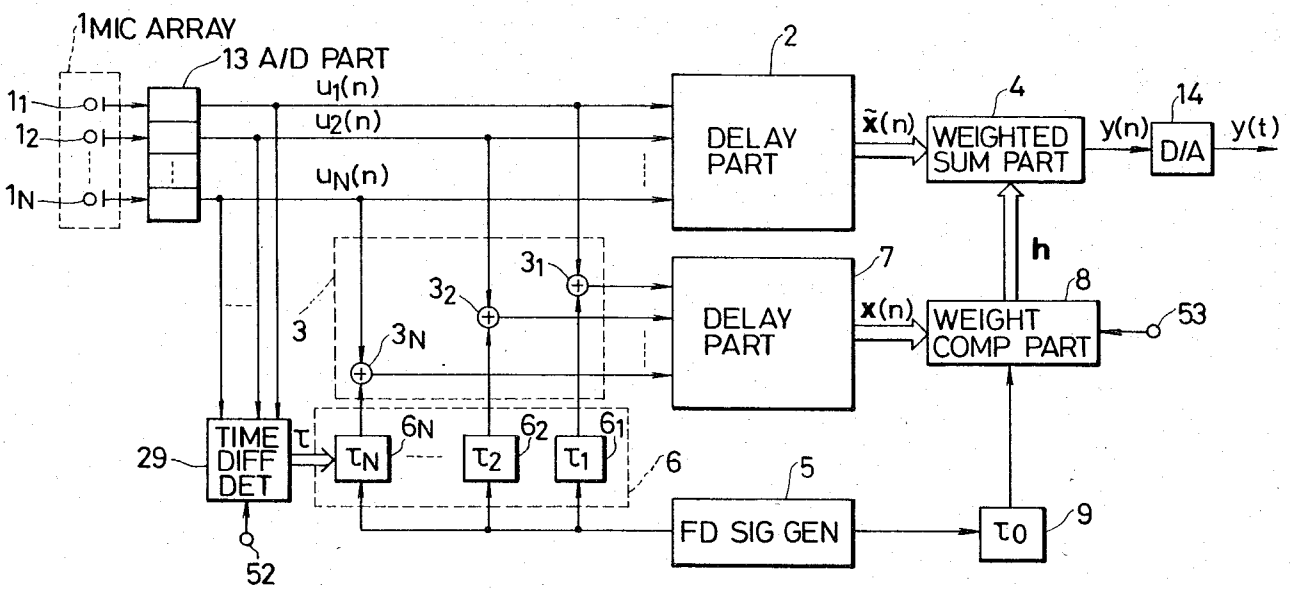
FIG. 9 is a block diagram illustrating an embodiment of the apparatus of the invention which is provided with desired signal arriving time difference detecting means.

FIG. 9 illustrates an embodiment of the present invention based on the above approach. In FIG. 9, an arriving time difference detection part 29 is added to the arrangement of FIG. 4, and the output of the A/D conversion part 13 is branched to the arriving time difference detection part 29. According to the detection results by the detection part 29, each delay time of the delay part 6 is set. In the arriving time difference detection part 29, as shown in FIG. 10, the respective outputs of the A/D conversion part 13 are provided to a cross-correlation function computing part 31 for the calculation of the cross-correlation function $\phi_{sij}(\tau)$ (where $i=1, 2, \ldots, N$ and j is any fixed value in the range of $1 \leqq j \leqq N$) between the microphone outputs $u_i(n)$ and $u_j(n)$, and the output of the cross-correlation function computing part 31 is applied to a maximum value detection part 32 to detect such a value $\tau_{Mij}$ of $\tau$ that maximizes the cross-correlation function $\phi_{sij}(\tau)$. Then, in an FD signal delay time determination part 34 the FD signal delay time $\tau=(\tau_1, \ldots, \tau_N)^T$ is determined by the following equation through using a value $\hat{\hat{\tau}}$ which is larger than all of the values $\tau_{Mij}$ (where $i=1, 2, \ldots N$, and j is a fixed value):

$$\tau_i=\hat{\hat{\tau}}-\tau_{Mij}$$

Figure 11:
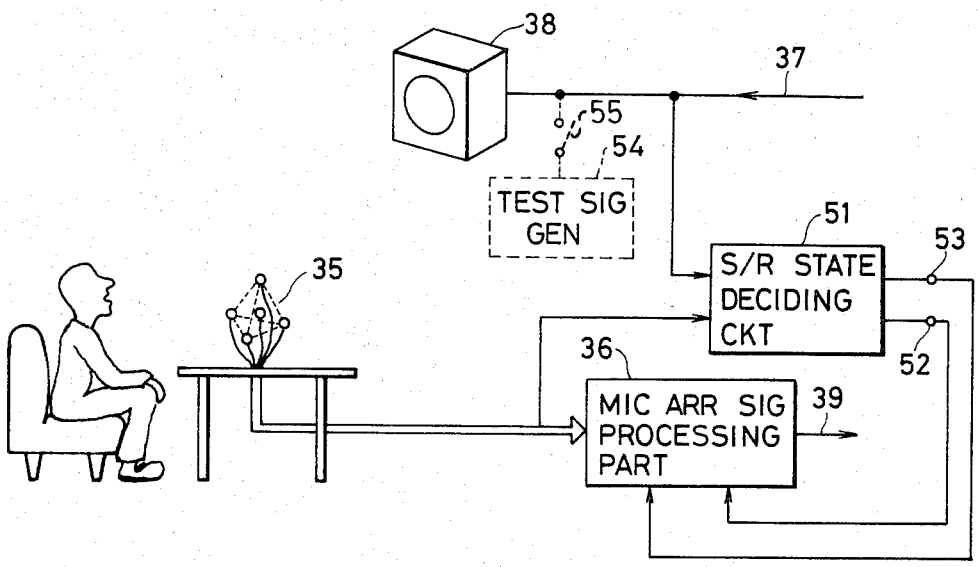
FIG. 11 is a schematic diagram illustrating an embodiment of the present invention as being applied to a tele-conference system.
Figure 12:
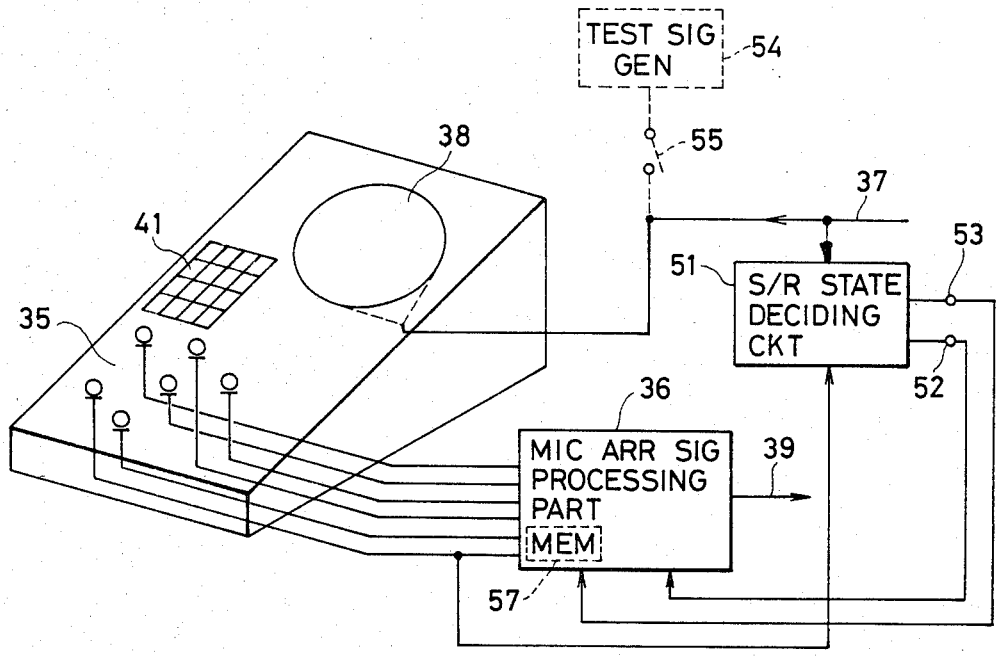
FIG. 12 is a schematic diagram showing an embodiment of the present invention as being applied to an all-in-one type loudspeaking telephone set.

Next, a description will be given of an additional function for automatically fulfilling the condition of Requirement-II. FIG. 11 illustrates another embodiment of the present invention applied to a tele-conference system, in which the output of a microphone-array 35 is applied to a microphone-array signal processing part 36 according to the present invention. A loudspeaker 38 is driven by a signal on a receiving channel 37, and the output of the microphone-array signal processing part 36 is output through a sending channel 39. FIG. 12 illustrates another embodiment of the present invention applied to an all-in-one type loudspeaking telephone set. The output of the microphone-array 35 is provided on the sending channel 39 via the microphone-array signal processing part 36. The loudspeaker 38 is driven by the signal from the receiving channel 37. A dial 41 is provided.

In the foregoing two examples, if the voice from the loudspeaker 38 is received by the microphone-array 35 and then transmitted through the sending channel 39, there occurs various troubles, such as howling, degradation of speech quality and so forth. In these examples the main noise is the voice generated from the loudspeaker 38, and the desired signal is the voice of a talker. The voice has silent periods, so that there exist the period in which only the noise is present and the period in which only the desired signal is present.

A send/receive state deciding circuit 51 is provided which is supplied with the signal from the receiving channel 37 and the receiving sound signal of the microphone-array 35 and works as follows: For instance, in the case where the signal level on the channel 37 is nearly 0 but the output level of the microphone-array 35 rises, the send/receive state deciding circuit 51 decides that only the desired signal exists, and issues from its terminal 52 an arriving time difference detect command to the arriving time difference detection part 29 in FIG. 9, causing it to set delay times corresponding to the detected arriving time differences in the FD signal delay part 6. Further, in the case where the signal level of the receiving channel 37 is higher than a certain value and the microphone output level is lower than a value which is determined by the signal level of the receiving channel 37 and the quantity of the acoustic coupling level between the loudspeaker and the microphone, the send/receive state deciding circuit 51 decides that only the noise exists, and issues from its terminal 53 a command for starting the weighting value computation to the weighting value computing part 8 in FIG. 9, setting the computed weighting values in the weighted summation part 4. As a result of this, the apparatus is able to perform the desired operation, and reduces the noises and automatically carries out selective reception of the desired signal. According to the prior art, what is called a voice switch is provided in such a loudspeaking telephone system as shown in FIGS. 11 and 12, receiving and sending channel signals are applied to the voice switch and, in accordance with the levels of these signals, the switch is changed over between transmission and reception, thereby preventing the occurrence of howling and so on. In the present invention, various send/receive deciding circuits in the voice switch can be employed in the send/receive deciding circuit 51.

In the case where the position of the desired signal source or the positions of the noise sources can be regarded as fixed, one or both of the aforesaid requirements can be satisfied by the following presetting methods. For example, in an all-in-one type loudspeaking telephone set shown in FIG. 12, the relative position of the main noise source, that is the loudspeaker 38 in this case, to each microphone element is fixed. A test signal generator 54 is connected to the loudspeaker 38 through a switch 55. By turning the switch 55 ON, in advance, a test signal (for instance, a white noise, colored noise, human voice or the like) is generated from a loudspeaker and received by the microphone-array. The signals received by the microphone elements are stored in a memory part 57 in the microphone-array signal processing part 36. Thus, by receiving, in advance, the sound from the loudspeaker 38, the condition of Requirement-II can be fulfilled. Accordingly, by setting the FD signal delay times $\tau_1$ to $\tau_M$ manually or by setting the delay times $\tau_1$ to $\tau_M$ automatically with the time difference detection part 29, the apparatus can be made to determine the weighting value in the aforesaid manner through using the stored test signal in memory part 57 as the received noise signal, and performs its operation. Moreover, in the case where the position of the talker, that is, the desired signal source position, can also be regarded as fixed and is known previously, it is possible to compute the weighting value h by calculating and setting, in advance, the arriving time differences as the FD signal delay times $\tau_1$ to $\tau_N$, supplying the test signal to the loudspeaker 38 from the test signal source 54 with its switch 55 ON at the time of starting to use the apparatus, and activating the weighting value computing part 8 with a switch 56 in FIG. 1 turned ON.

It is also possible to employ such means as follows: On the assumption that the positions of the noise sources are substantially fixed, only the noises are received in advance and stored in the memory part 57. Next, K weighting values $h_1$ to $h_k$ are determined in advance using the stored noise signals in the memory part 57 and the FD signal delay times $\tau_1$ to $\tau_N$ for each of the predicted positions $P_1$ to $P_K$ of K predicted desired signal sources. When the desired signal source lies at the position $P_i$, the desired signal can be effectively extracted by operating the apparatus using the weighting value $h_i$. And it is possible to perform such an effective operation by preparing K weighted summation parts 4, producing their Outputs $y_1=h_1^TX, \ldots, y_K=h_K^TX$ and selecting therefrom, for example, the output of the highest signal level. This method corresponds to the selective use of K directional microphones which are low in response to noises but high in response to the desired signal from the desired signal source at the position $P_i$. This method is of utility when employed in the case of a plurality of talkers for one microphone-array 1. Further, by employing, as the output of this system, $$y = \sum_{i=1}^{K} y_i,$$

a sound receiving system is constituted whioh is low in the response to noise source direction but high in the response to some desired directions.

In accordance with the present invention described in the foregoing, noises in the received signals can be reduced but the desired signal may sometines become distorted and degraded. This degradation can be avoided by suitable control of the FD signal level. In connection with this, a description will be given first of the degradation of the desired signal and then of the arrangement for controlling the FD signal level for preventing the degradation.

The aforementioned means square error E of Eq. (5) can be expressed as follows, through using a convolution with each impulse response $h_i(t)$ of a filter given by Eq. (2), as is the case with Eq. (3):

$$E = \overline{\left| A \cdot s'(t-\tau_0) - \sum_{i=1}^{N} h_i(t) \oplus \tilde{u}_i(t) \right|^2} \tag{9}$$

Further since $\hat{u}_i(t)$ consists of the delayed FD signal and the noise signal $u_i(t)$ received by the microphone element $\mathbf{1}_i$, it follows that $$\tilde{u}_i(t) = A \cdot s'(t-\tau_i) + u_i(t) \tag{10}$$

Therefore, if the FD signal and the noise signal are uncorrelated to each other, then Eq. (9) can be expressed as follows:

$$E = A^2 \cdot \overline{\left| s'(t-\tau_0) - \sum_{i=1}^{N} h_i(t) \oplus s'(t-\tau_i) \right|^2} + \overline{\left| \sum_{i=1}^{N} h_i(t) \oplus u_i(t) \right|^2} \tag{11}$$

And, by giving the following definitions:

$$D_1 \triangleq \overline{\left| s'(t-\tau_0) - \sum_{i=1}^{N} h_i(t) \oplus s'(t-\tau_i) \right|^2} \tag{12}$$

$$D_2 \triangleq \overline{\left| \sum_{i=1}^{N} h_i(t) \oplus u_i(t) \right|^2} \tag{13}$$

the mean square error E can be expressed as follows:

$$E = A^2 \cdot D_1 + D_2 \tag{14}$$

Now, $D_1$ expressed by Eq. (12) is such a physical quantity as follows:

Assuming that s'(t) is a stationary random signal, $D_1$ can be expressed as follows using the Wiener-Khinchine's theorem:

$$D_1 = \frac{1}{2\pi} \int_{-\infty}^{\infty} |S'(\omega)|^2 \cdot \left| e^{-j\omega\tau 0} - \sum_{i=1}^{N} H_i(\omega) \cdot e^{-j\omega\tau i} \right|^2 d\omega \tag{15}$$

where $|S'(\omega)|^2$ is the power spectrum of the FD signal s'(t) and $H_i(\omega)$ is a Fourier transformation of $h_i(t)$. Let the quantity $F(\omega)$ be defined by the following equation:

$$F(\omega) \triangleq \sum_{i=1}^{N} H_i(\omega) \cdot e^{-j\omega\tau i} \tag{16}$$

This $F(\omega)$ represents the frequency response in the case where a signal is delayed by each of $\tau_i$ (i=1 to N) and subjected to filtering of $H_i(\omega)$ and then added together. Since $\tau_1$ to $\tau_N$ represent the arriving time differences in the case of actual desired signal being received by the microphone elements as referred to previously, it will be understood that $F(\omega)$ represents the frequency response of the microphone-array apparatus to the desired signal. Eq. (15) indicates that a square deviation of the frequency response $F(\omega)$ of the microphone-array apparatus from the response (i.e. $F_0(\omega)=e^{-j\omega\tau_0}$) *which imposes no distortion on the amplitude response and provides a pure delay is weighted by the power spectrum* $|S'(\omega)|^2$ of the FD signal and then integrated. Therefore, it will be seen that $D_1$ is the quantity representing the degradation of the frequency response to the desired signal (hereinafter $D_1$ is referred to as the desired signal degradation) of the microphone-array apparatus.

Further, the above discussion reveals that the FD signal has the function of a test signal for evaluating the desired signal degradation, and that it is necessary to select, as the FD signal, a random signal which has a continuous spectrum in a desired frequency band. It is possible to employ, as such an FD signal, for example, a band-limited white noise as described previously.

Next, it will easily be understood that $D_2$ expressed by Eq. (13) represents the power of a noise component contained in the output y(t) of the microphone-array apparatus.

From the above it will be appreciated that the mean square error E expressed by Eq. (5) is a quantity of a linear combination of the desired signal degradation $D_1$ and the output noise power $D_2$. Accordingly, it is predicted that the microphone-array apparatus which suppresses the degradation of the desired signal and reduces the output noise power is implemented by obtaining the weighting value $\hat{h}$ which minimizes the value of E. The weighting value $\hat{h}$ which minimizes the mean square error E expressed by Eq. (5) is obtainable with Eq. (7) as described previously.

Even if the value h obtained with Eq. (7) is directly used as the weighting value in the weighted summation part 4, the noise-reduced sound receiving operation can be carried out as described previously. In this case, however, the characteristic of the microphone-array apparatus differs with the set value of the FD signal level $A^2$ as follows:

Now, let the weighting value obtained with Eq. (7) by setting the FD signal level to $A^2$ be represented by $\hat{h}(A^2)$, and the desired signal degradation and the output noise power in the case of using the weighting value $\hat{h}(A^2)$ be represented by $D_1(A^2)$ and $D_2(A^2)$, respectively. Then, the following relations Rel 1 and Rel 2 are proved:

Rel 1: The desired signal degradation $D_1(A^2)$ takes a value in the range of $0 \leqq D_1(A^2) \leqq 1$, and it is a monotone decreasing function of $A^2$. The output noise power $D_2(A^2)$ is a monotone increasing function of $A^2$.

Rel 2: The weighting value $\hat{h}(A^2)$ is such that it provides the minimum output noise power $D_2$ among those weighting values which render the desired signal degradation smaller than $D_1(A^2)$.

Figure 13:
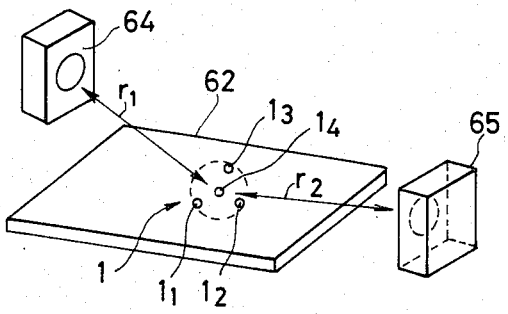
FIG. 13 is a perspective view showing experimental conditions.

This monotonous relationship corresponds to the following experimental results: The experimental conditions used are shown in FIG. 13. As the microphone-array 1, a total of four microphone elements $\mathbf{1}_1$ to $\mathbf{1}_4$ were disposed on a plane baffle 62, three on the circumference of a circle with a radius of 8.5 cm and one at the center of the circle. A loudspeaker 64 for generating a noise and a loudspeaker 65 for the desired signal were disposed at distances $r_1$ and $r_2=0.5$ m apart from the center of the microphone-array 1. As the noise, the desired signal and the FD signal, band-limited white noise signals of the frequency band of 300 to 3000 Hz were used, respectively.

The flatness of the frequency response $f(\omega)$ of the apparatus to the desired signal was quantified as given by the following equation:

$$\text{Flatness} \triangleq \left( \frac{1}{2\pi(3000-300)} \int_{300\times 2\pi}^{3000\times 2\pi} |10 \cdot \log|F(\omega)|^2 - Fm|^2 d\omega \right)^{\frac{1}{2}} \tag{17}$$

where $$Fm = \frac{1}{2\pi(3000-300)} \int_{300\times 2\pi}^{3000\times 2\pi} 10 \cdot \log|F(\omega)|^2 d\omega$$

Eq. (17) represents the flatness of $|F(\omega)|^2$ based on a standard deviation on the log-frequency response. The flatter $|F(\omega)|^2$ is, the smaller the value of Eq. (17) becomes, and when $|F(\omega)|^2$ is completely flat, the value of Eq. (17) is zero. Further, the output signal SN ratio was defined by the following equation:

$$[\text{Output signal SN ratio}] \triangleq \frac{[\text{Power of desired signal component in output signal}]}{[\text{Power of noise component in output signal}]} \tag{18}$$

Moreover, the input signal SN ratio was defined in a manner similar to Eq. (18) and an SN ratio improvement was defined by the following equation:

$$[\text{SN ratio improvement}] = \frac{[\text{Output signal SN ratio}]}{[\text{Input signal SN ratio}]} \tag{19}$$

Figure 14:
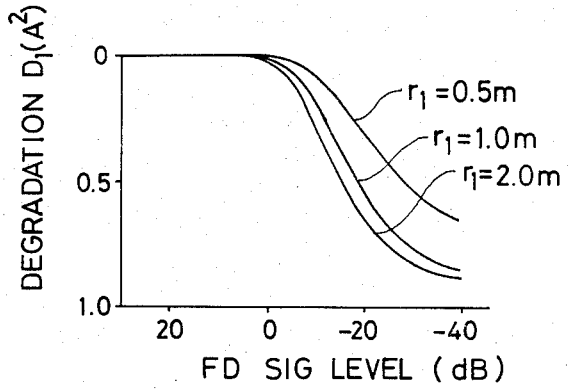
FIG. 14 is a graph showing the relation between the level of the FD signal and the degradation of the frequency response to desired signal.
Figure 15:
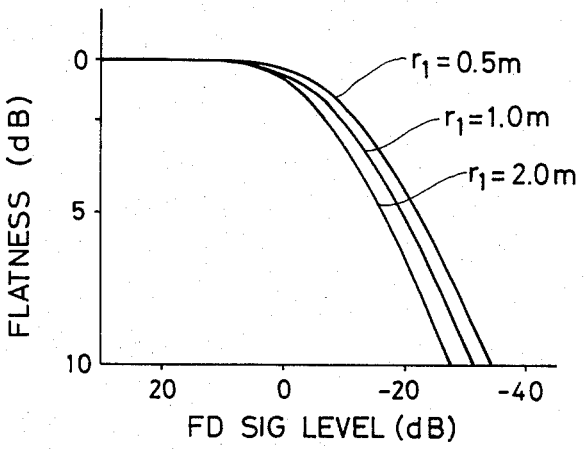
FIG. 15 is a graph showing the relation between the level of the FD signal and the flatness of the frequency response to the desired signal.
Figure 16:
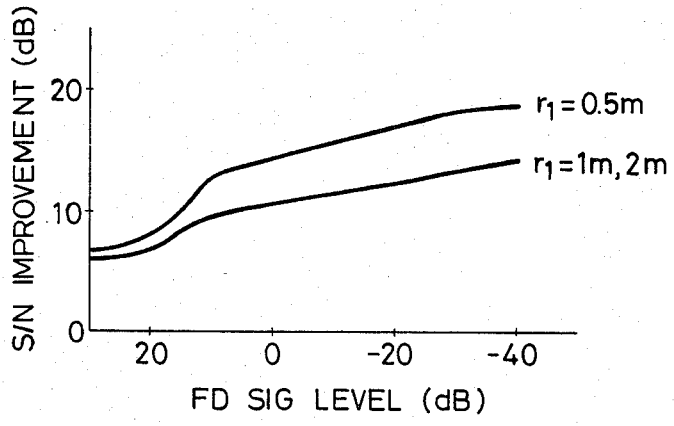
FIG. 16 is a graph showing the relation between the level of the FD signal and SN ratio improvement.

FIGS. 14, 15 and 16 show the characteristics of this apparatus obtained by changing the distance $r_1$ to 0.5, 1 and 2 m based on the above conditions and processing respectively received noise with the level of the FD signal altered corresponding thereto. The level of the FD signal which is represented as a relative value to the level of the received noise in FIGS. 14, 15 and 16 was changed in the range of +30 to −40 dB. FIG. 14 shows the relation between the level of the FD signal and the degradation $D_1(A^2)$ of the frequency response to the desired signal. It appears from FIG. 14 that $D_1(A^2)$ is a monotone decreasing function of $A^2$ as mentioned previously. FIG. 15 shows the level of the FD signal and the flatness of the frequency response of the desired signal defined by Eq. (17). As will be seen from FIG. 15, when the level of the FD signal is high (+10 dB or more), the frequency response is substantially flat (flatness ≅0) but as the level of the FD signal is lowered, the flatness is gradually degraded regardless of the distance $r_1$. FIG. 16 shows the relation between the level of the FD signal and the SN ratio improvement. From FIG. 16 it will be understood that the value of the SN ratio improvement differs with the distance $r_1$ between the noise source and the center of the microphone array, but that as the level of the FD signal is lowered, the SN ratio improvement rises regardless of the distance $r_1$.

As will be appreciated from the above experimental results, the characteristic of the microphone-array apparatus in the case where use is made of the weighting value calculated from Eq. (7) with a relatively high FD signal level $A^2$, is such that the desired signal degradation is small although the noise reduction effect, i.e. the SN ratio improvement is small. Further, the characteristic of the apparatus which uses the weighting value calculated with a relatively low FD signal level $A^2$ is that the noise reduction effect is large although the desired signal degradation is large. This fact indicates such a problem that with an excessively large $A^2$, a sufficient noise reduction effect cannot be obtained, whereas, with an excessively small $A^2$, the desired signal is markedly degraded.

But the relationships of the FD signal level $A^2$ and $D_1(A^2)$ and $D_2(A^2)$ cannot be determined unequivocally but differ according to various noise conditions. Accordingly, suitable control of the FD signal level is important. Description will be given hereinafter of a method which minimizes the output noise power while maintaining the desired signal degradation lower than a certain constant value $\hat{D}_1$. The method can be implemented on the basis of aforementioned relationship Rel 2 by controlling the FD signal level $A^2$ so as to obtain a weighting value $h(A^2)$ which renders the desired signal degradation $D_1(A^2)$ equal to $\hat{D}_1$.

The procedure of this control is as follows:

At first, a threshold value $\hat{D}_1$ of the desired signal degradation is set. The threshold value $\hat{D}_1$ is the permissible value for hearing which is determined by subjective tests according to the purpose of use. In practice, the threshold value is selected in the range of $0.05 \leqq D_1 \leqq 0.5$.

Then the FD signal level $A^2$ is controlled by changing the level $A^2$ such that the value of $A^2$ is decreased when $D_1(A^2) < \hat{D}_1$ and the value of $A^2$ is decreased when $D_1(A^2) > \hat{D}_1$.

It has been proved experimentally that $D_1(A^2) \simeq 0$ when the FD signal level $A^2$ is selected sufficiently large within the range in which the matrix $C_x$ in Eq. (7) fulfills regularity. Further, it will be seen that when $A^2$ is selected sufficiently small, $\hat{h}(A^2) \cong 0$ from Eq. (7) and $D_1(A^2) \simeq |s'(t-\tau_0)|^2 = 1$ from Eq. (12). And $D_1(A^2)$ becomes a monotone decreasing function of $A^2$ between $D_1(A^2) \simeq 1$ and $D_1(A^2) \simeq 0$ as described previously. Accordingly, by the above control of the FD signal level $A^2$, the value of $D_1(A^2)$ can be converged on the range $\hat{D}_1 - \Delta D_1 \leqq D_1(A^2) \leqq \hat{D}_1 + \Delta D_1$ centering about $\hat{D}_1$. And, when the value of $A^2$ which provides $D_1(A^2) = \hat{D}_1$ obtained by such control, it is proved that the weighting value $\hat{h}(A^2)$ at that time is such one that minimizes the value of the output noise power $D_2$ under the condition that the desired signal degradation is smaller than $\hat{D}_1$. In short, the fundamental principle of determination of the weighting value by the control of the FD signal level is based on the optimization principle that minimizes the output noise power level $D_2$ under the condition that the degradation $D_1$ of the frequency response to the desired signal is made smaller than the predetermined value $\hat{D}_1$.

Figure 17:
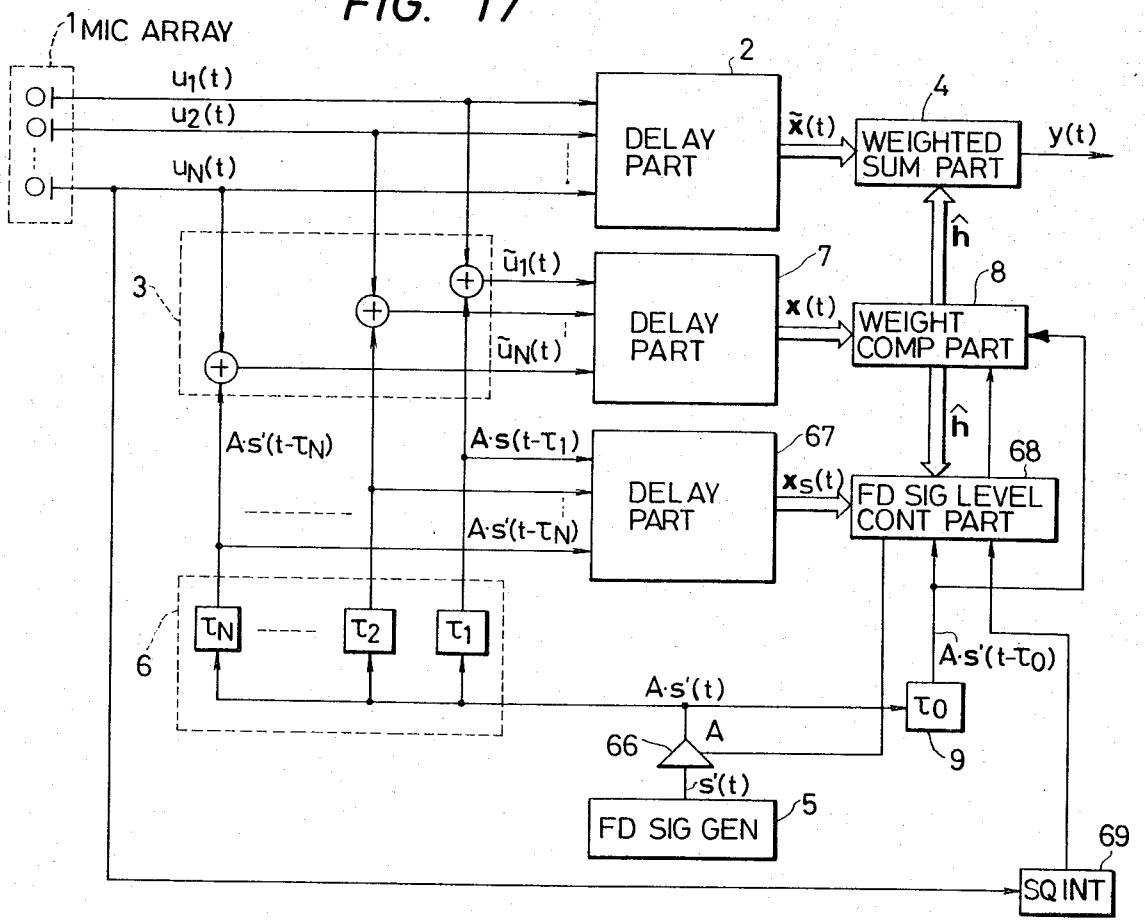
FIG. 17 is a block diagram illustrating an embodiment of the apparatus of the present invention which controls the FD signal level.

FIG. 17 illustrates an embodiment of the present invention based on the approach described above. In this embodiment, an FD signal amplifier 66, a delay part 67, an FD signal level control part 68 and a square integrator 69 are added to the arrangement of FIG. 1. The FD signal amplifier 66 is a variable gain amplifier, which amplifies the FD signal from the FD signal generator 5 and supplies it to the FD signal delay part 6 and the delay element 9. The delay part 67 is identical in construction with the delay parts 2 and 7, and it is supplied with the output signals $A \cdot s'(t-\tau_1)$ to $A \cdot s'(t-\tau_N)$ from the FD signal delay part 6 and provides the delayed output $X_s(t)$ to the FD signal level control part 68. To the FD signal level control part 68 are also applied the weighting value $\hat{h}$ from the weighting value computing part 8, the FD signal $A \cdot s'(t-\tau_0)$ from the delay element 9 and the input noise power from the square integrator 69 and, in accordance with these inputs, the FD signal level control part 68 sets up the gain A of the FD signal amplifier 66.

The FD signals $A \cdot s'(t-\tau_1)$ to $A \cdot s'(t-\tau_N)$ delayed by $\tau_1$ to $\tau_N$, respectively, in the FD signal delay part 6 are provided to the delay part 67 to yield a signal $X_s(t)$. Next, the FD signal level control part 68 performs the following operation: At first, in the FD signal level control part 68 the signal $X_s(t)$ is weighted with the weighting value $\hat{h}$ obtained from the weighting value computing part 8 in accordance with Eq. (7) and summed up. This corresponds to the calculation expressed by the following equation:

$$y_s'(t) = \sum_{i=1}^{N} \hat{h}_i(t) \otimes A \cdot s'(t - \tau_i) \tag{20}$$

Accordingly, by subtracting $y_s(t)$ from the FD signal $A \cdot s'(t-\tau_0)$ derived from the delay element 9, obtaining a mean square value of the subtraction result and then dividing the mean square by $A^2$, it is possible to obtain the value of a desired signal degradation $D_1(A^2)$ expressed by Eq. (12).

Figure 18:
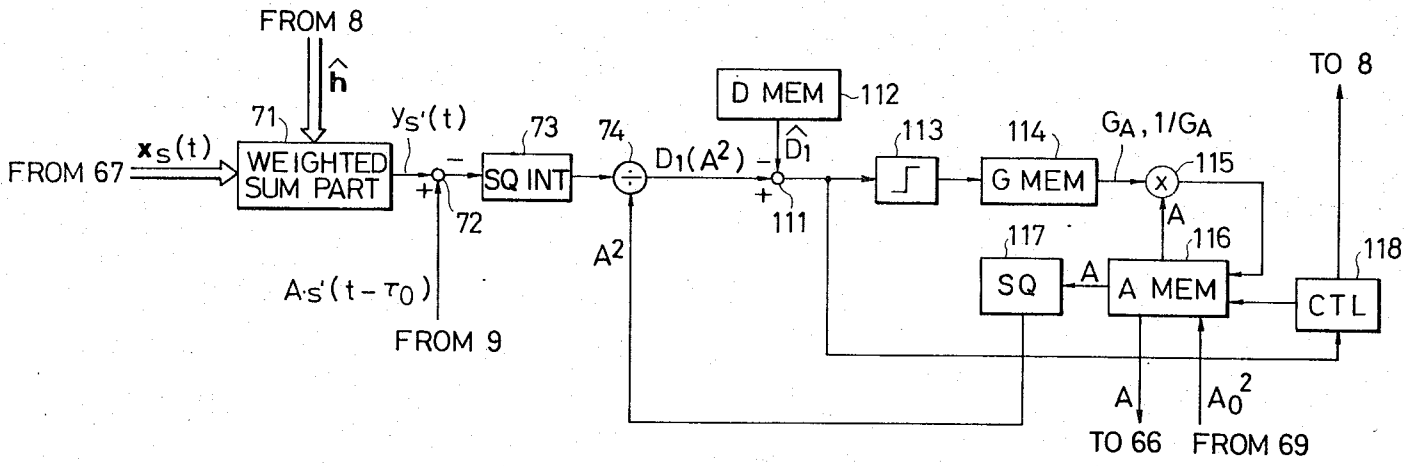
FIG. 18 is a schematic diagram illustrating a specific example of an FD signal level control part 68 which employs degradation $D_1$ of the frequency response to the desired signal as the measure of a degradation.

Next, FIG. 18 illustrates a specific example of the FD signal level control part 68. In a weighted summation part 71 which is identical in construction with the weighted summation part 4, the signal $X_s(t)$ from the delay part 67 is weighted using the weighting value $\hat{h}$ obtained from the weighting value computing part 8 and summed up, producing a signal $y_s'(t)$. The signal $y_s'(t)$ is provided to an adder 72, wherein it is subtracted from the FD signal $A \cdot s'(t-\tau_0)$ provided from the delay element 9. The subtracted output is square-integrated by a square integrator 73.

The output of the square integrator 73 is divided, in a divider 74, by the power level value $A^2$ of the FD signal from a squarer 117 to obtain the desired signal degradation $D_1(A^2)$.

The desired signal degradation $D_1(A^2)$ from the divider 74 is provided to an adder 111, wherein it subtracts therefrom the threshold value $\hat{D}_1$ prestored in a memory part 112. The output of the adder 111 is applied to a sign decider 113, which produces an output $+1$ when the input thereto is positive, that is, when $D_1(A^2) - \hat{D}_1 \geqq 0$, and produces an output $-1$ when the input thereto is negative, that is, when $D_1(A^2) - \hat{D}_1 < 0$. The output of the sign decider 113 is input into a memory part 114. The memory part 114 has prestored therein predetermined constants $G_A$ ($G_A > 1$) and $1/G_A$ for altering the FD signal amplitude level, and it outputs $G_A$ or $1/G_A$ depending upon whether the input thereto from the sign decider 113 is $+1$ or $-1$. The output of the memory part 114 is multiplied, in a multiplier 115, by the FD signal amplitude level value A held in an FD signal amplitude level memory part 116. The multiplication result from the multiplier 115 is input again into the FD signal amplitude level memory part 116 to update its content, holding the value again. As a result of this, when $D_1(A^2) > \hat{D}_1$, the value of the FD signal amplitude level A is increased by a factor of $G_A$ (where $G_A > 1$), and hence it increases by $20 \cdot \log G_A$ dB. Similarly, when $D_1(A^2) < \hat{D}_1$, it is decreased by $20 \cdot \log G_A$ dB. The updated FD signal amplitude level value is provided as the gain A to the FD signal amplifier 66 in FIG. 17. Further, the value of the amplitude level A is input into the squarer 117, the output of which is input as the FD signal power level $A^2$ to the divider 74.

The above FD signal amplitude level updating operation takes place at the following moment. At first, the new weighting value $\hat{h}$ calculated from Eq. (7) is supplied from the weighting value computing part 8 in FIG. 17 to the weighted summation part 71 in FIG. 18. In the weighted summation part 71, $X_s(t)$ is weighted and summed up using $\hat{h}$, and the addition result is subjected to a subtraction, a square integration and a division, obtaining the desired signal degradation $D_1(A^2)$ as mentioned above. In this case, however, a period $T_s$ related to the time constant of the square integrator is needed for the output of the square integrator 73 to become stable after updating of the weighting value in the weighted summation part 71. For this reason, in the case of the weighting value having been updated in the weighted summation part 71, a controller 118 issues a level update command signal to the FD signal amplitude level memory part 116 after the period $T_s$ predetermined in consideration of the characteristic of the square integrator 73 and, at the instant of receiving the level update command signal, the level updating operation is conducted. At the same time, the controller 118 issues to the weighting value computing part 8 a signal instructing it to start an operation for computing a new weighting value. Further, the controller 118 is supplied with the value of the output $D_1(A^2) - \hat{D}_1$ of the adder 111 and when it has become such that $-\Delta D_1 \leqq D_1(A^2) - \hat{D}_1 \leqq \Delta D_1$ for the predetermined value of $\Delta D_1$, the controller 118 applies an operation end command signal to the weighting value computing part 8 and the FD signal amplitude level memory part 116.

In the above FD signal level control operation, by making the value of the alteration constant $G_A$ of the FD signal amplitude level sufficiently small, the value of the desired signal degradation $D_1(A^2)$ can be converged within the range $\hat{D}_1-\Delta D_1 \leqq \hat{D}_1(A^2) \leqq \hat{D}_1+\Delta D_1$. In concrete terms, it has been ascertained experimentally that, for instance, when $D_1=0.15$ and $\Delta D_1=0.05$, then the value of the desired signal degradation $D_1(A^2)$ can sufficiently be converged by selecting that $G_A=1.25$ ($20 \cdot \log G_A=2$ dB).

Moreover, it has been ascertained from the experimental results obtained so far that when the initial value $A_0$ of the FD signal amplitude level A is selected the same as the received noise amplitude level, the desired signal degradation $D_1(A^2)$ is rapidly converged. Therefore, the received noise signal is square-integrated by the square integrator 69 in FIG. 17 and the integrated output $A_0^2$ is input into the FD signal amplitude level memory part 116, deciding its square root $A_0$ as the initial value of the FD signal amplitude level A.

Then, the weighting value $\hat{h}$ in the weighting value computing part 8 at the moment of completion of the above control operation is provided as the weighting value in the weighted summation part 4, by which it is possible to perform the noise reducing operation while maintaining the desired signal degradation constant at all times.

In determining the weighting value through the use of the recursive algorithm shown by Eq. (8) in a digital implementation of this invention apparatus, the arrangement of the FD signal level control part 68 can be the same as a direct digital implementation of FIG. 18. In this case, however, the updated weighting value h(n) is always supplied from the weighting value computing part 8 in FIG. 17 to the weighting value computing part 71 in FIG. 18. And the controller 118 issues, at regular time intervals $T_s$ predetermined in view of the characteristic of the square integrator, a level update command signal, performing the level updating operation. The decision of the end of this operation is made in the following manner: The output signal $D_1(A^2)-\hat{D}_1$ of the adder 111 is input into the controller 118 and when it becomes such that $-\Delta D_1 \leqq D_1(A^2)-\hat{D}_1 \leqq \Delta D_1$ for a certain $T_r$ predetermined in view of the convergence time of the recursive algorithm, the controller 118 provides an operation end command signal to the weighted summation part 8 and the FD signal amplitude level memory part 116.

As the measure D representing the degradation of the frequency response to the desired signal, the following various quantities can also be selected other than the quantity $D_1$ defined by Eq. (12) and can be used to control the FD signal level in a similar manner. In accordance with a first method, the flatness expressed by Eq. (17) is employed as the measure and a microprocessor or like arithmetic unit is used as the FD signal level control part 68 in FIG. 17 and the flatness is calculated directly therefrom through using h and $\tau_1$ to $\tau_0$. A second method is to select, as the measure D of the degradation, a squared value of a correlation coefficients R ($D=R^2$), between the weighted summation output $y_s'(t)$ defined by Eq. (21)

$$y_s'(t) = \sum_{i=1}^{L} h_i x_{si}(t) \tag{21}$$

and $A \cdot s'(t-\tau_0)$, where the correlation coefficient R is given as follows:

$$R = \overline{A \cdot s'(t-\tau_0) \cdot y_s'(t)} \,/\, \overline{(|A \cdot s(t-\tau_0)|^2 \cdot |y_s'(t)|^2)^{\frac{1}{2}}} \tag{22}$$

Figure 19:
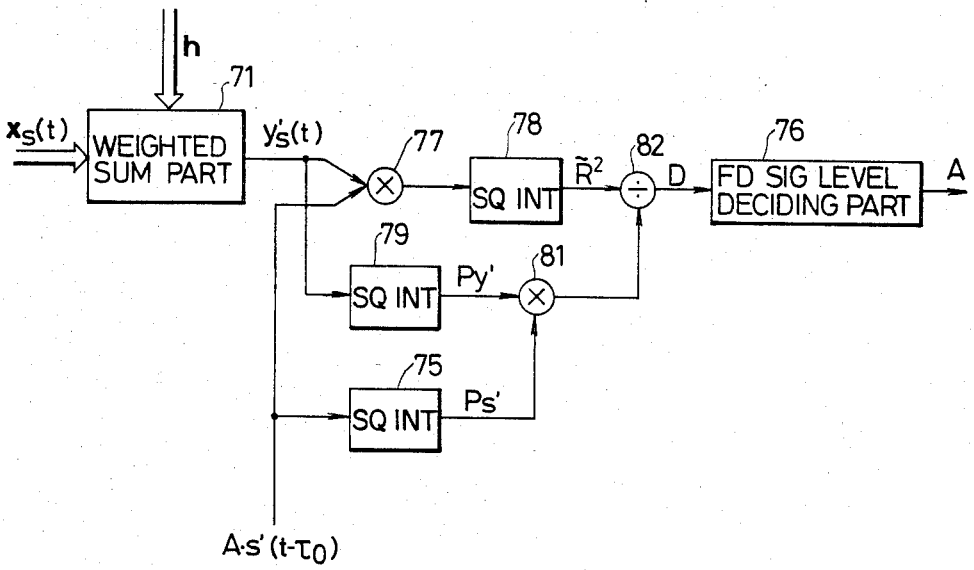
FIG. 19 is a block diagram showing a specific example of the FD signal level control part 68 which employs a correlation coefficient R as the measure of the degradation.

In this case, when the degradation is large, $R^2 \approx 0$ and, when the degradation is small, $R^2 \approx 1$. Therefore, the measure D assumes a value within the range $0 \leqq D \leqq 1$. FIG. 19 illustrates an embodiment of the FD signal level control part 68 in FIG. 17 in the case of $D=R^2$. In the weighted summation part 71, a calculation is performed in accordance with Eq. (21) using $X_s(t)$ and h, whereby producing the signal $y_s'(t)$.

Next, $A \cdot s'(t-\tau_0)$ and $y_s'(t)$ are multiplied in multiplier 77, the multiplied output of which is applied to a square integrator 78, obtaining a signal $\tilde{R}^2$. The signal $\tilde{R}^2$ is expressed by the following equation:

$$\tilde{R}^2 = \overline{|A \cdot s'(t-\tau_0) \cdot y_s'(t)|^2} \tag{23}$$

The signals $y_s'(t)$ and $A \cdot s'(t-\tau_0)$ are applied to square integrators 79 and 75, respectively, obtaining signals $P_y'$ and $P_s'$ which are expressed as follows:

$$P_y' = \overline{|y_s'(t)|^2} \tag{24}$$

$$P_s' = \overline{|A \cdot s'(t-\tau_0)|^2} \tag{25}$$

These signals $P_y'$ and $P_s'$ are multiplied in a multiplier 81 and $\tilde{R}^2$ is divided by the multiplied output in a divider 82. As a result of this, the desired measure D $$D=R^2=\tilde{R}^2/(P_y' \cdot P_s') \tag{26}$$

is obtained. Finally, in the FD signal level deciding part 76 a predetermined threshold value $\hat{D}$ and the output D from the divider 82 are compared, controlling the gain of the FD signal amplifier 66 so that $\hat{D}-\Delta D \leqq D \leqq \hat{D}+\Delta D$ in the same manner as described previously.

Also it is possible to select, as the measure D representing the degradation of the frequency response to the desired signal, the following quantity $E_0$ obtained by normalizing the mean square error E of Eq. (5) through using the power level $A^2$ of the FD signal:

$$E_0 = \overline{\left| A \cdot s'(t-\tau_0) - \sum_{j=1}^{L} h_j \cdot x_j(t) \right|^2} \,/\, A^2 \tag{27}$$

Since the quantity $E_0$ bears the following relation from Eq. (14)

$$E_0 = D_1 + \frac{1}{A^2} D_2 \geqq D_1 \tag{28}$$

it is guaranteed that $D_1 \leqq \hat{D}_1$ holds at all times by controlling such that $E_0$ may be smaller than $\hat{D}_1$. The advantage of using $E_0$ as the measure for representing the desired signal degradation resides in the easiness of its computation. For calculating $D_1$ represented by Eq. (12), and R expressed by Eq. (22), it is necessary to provide the delay part 67 as shown in FIG. 17 in addition to the apparatus depicted in FIGS. 1, 4 and 7. With the use of the quantity $E_0$ of Eq. (27), the delay part 67 need not be provided.

Figure 20:
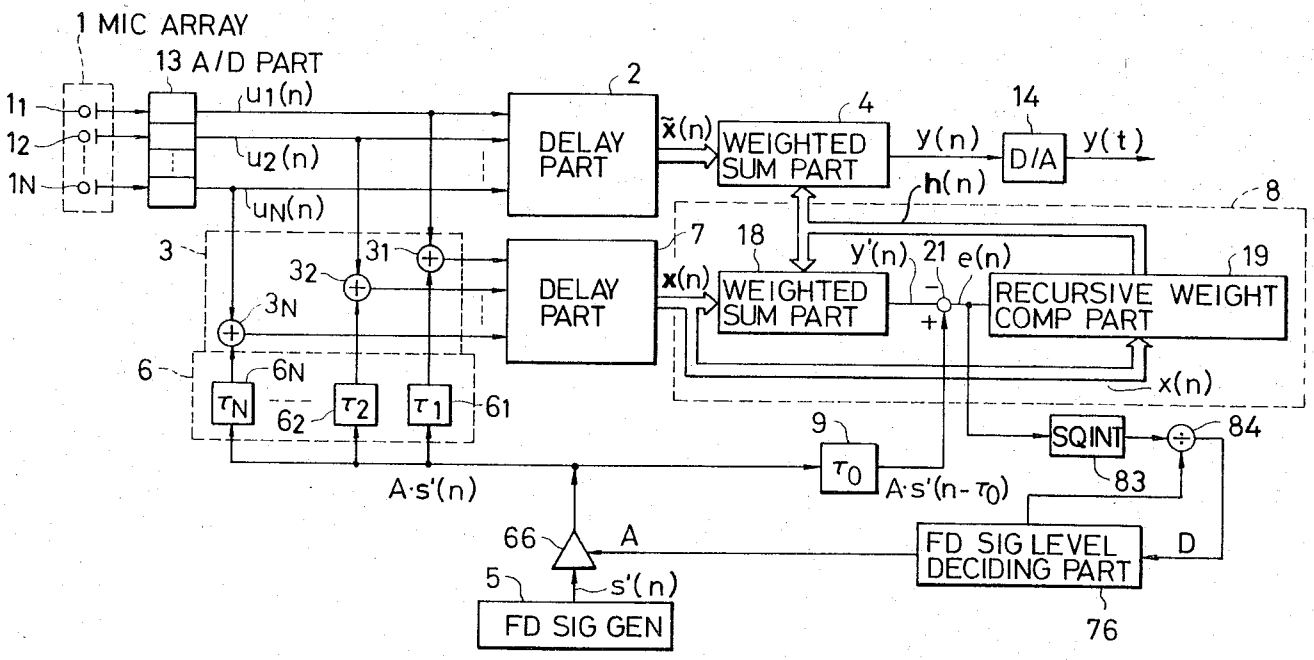
FIG. 20 is a block diagram illustrating an embodiment of the apparatus of the present invention which uses a mean square error normalized by the FD signal power level $E_0$ as the measure of the degradation.

FIG. 20 illustrates another embodiment of the present invention in which E expressed by Eq. (27) is used as the measure D of the degradation of the frequency response to the desired signal. This embodiment differs from the embodiment of FIG. 7 in the provision of an FD signal amplifier 66, a square integrator 83 which is supplied with an error signal e(n), a divider 84 for dividing the output of the square integrator 83 by the power level $A^2$ of an FD signal from an FD signal level deciding part 76 and the FD signal level deciding part 76 for deciding the FD signal level based on the output of the divided output.

The FD signal level control operation in the embodiment of FIG. 20 starts with the application of the output signal e(n) of the adder 21 to the square integrator 83 to obtain $$\overline{|e(n)|^2} = \overline{\left| A \cdot s'(n - \tau_0) - \sum_{j=1}^{L} h_j \cdot x_j(n) \right|^2}.$$

By dividing $\overline{|e(n)|^2}$, in divider 84, by the power level $A^2$ of the FD signal from the FD signal level deciding part 76, it is possible to obtain the mean square error $E_0$ normalized by $A^2$ which is expressed by Eq. (27). This means that the measure of the degradation D has now been obtained, since in this case $D=E_0$. This D is provided to the FD signal level deciding part 76, wherein it is compared with the predetermined threshold $\hat{D}$, and the value of the gain A of the FD signal amplifier 66 is controlled so that $\hat{D}-\Delta D \leqq D \leqq \hat{D}+\Delta D$ holds in the same manner as described previously.

A simpler method for controlling the FD signal level is to retain the value of the FD signal level at a fixed value $P_{SN}$ relative to the received noise level. In this case, the FD signal amplifier 66 is controlled so that the FD signal level keeps the constant level $P_{SN}$ dB with respect to the noise level but, in consideration of the results of subjective experiments, it is assumed that the value $P_{SN}$ is set smaller than +10 dB in accordance with the noise level.

Another control method is to manually set the FD signal level while ascertaining the operation of the apparatus by listening test.

The delay parts 2, 7 and 67, the weighted summation parts 4, 18 and 71, the weighting value computing part 8 and the FD signal level control part 68 can be implemented wholly or partly through using arithmetic means, such as a microprocessor.

Figure 21A:
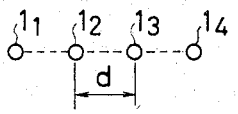
FIGS. 21A to 21E are schematic diagrams showing examples of arrangement of microphone elements.
Figure 21B:
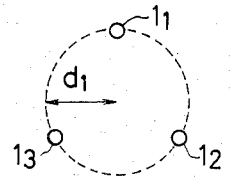
Figure 21C:
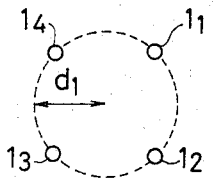
Figure 21D:
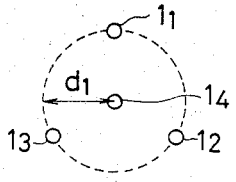

Next, a description will be given of the arrangement of the microphone elements. In FIG. 21A four microphone elements $1_1$ to $1_4$ are aligned at regular intervals d. In FIG. 21B three microphone elements $1_1$ to $1_3$ are disposed at equiangular intervals on the circumference of a circle with a radius $d_1$. In FIG. 21C four microphone elements $1_1$ to $1_4$ are disposed at equiangular intervals on the circumference of the circle with the radius $d_1$. In FIG. 21D three microphone elements $1_1$ to $1_3$ are disposed at equiangular intervals on the circumference of the circle with the radius $d_1$ and another microphone element $1_4$ is placed at the center of the circle.

Figure 22:
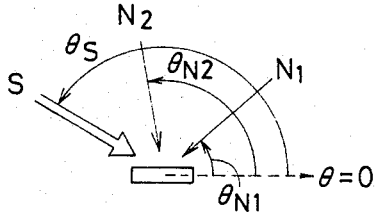
FIG. 22 is a schematic diagram showing the relation between the direction of arrival of the desired signal and the directions of arrival of the noises used as conditions for simulation.

By simulating, with the use of an electronic computer, the state in which white noises $N_1$ and $N_2$ of the same power arrive at the microphone array 1 from directions $\theta_{N1}$ and $\theta_{N2}$ and the desired signal, which is also a white noise, arrives from a direction $\theta_s$ as shown in FIG. 22, the SN ratio improvement of this invention apparatus was checked with the microphone element spacing d and the radius $d_1$ changed. It was assumed that the sound field was a two-dimensional one and that sound waves were all plane waves. The number of delay taps M of the delay part 2 was sixteen, the frequency band used was 300 to 3000 Hz, and the FD signal was a white noise in the range of 300 to 3000 Hz.

Figure 23:
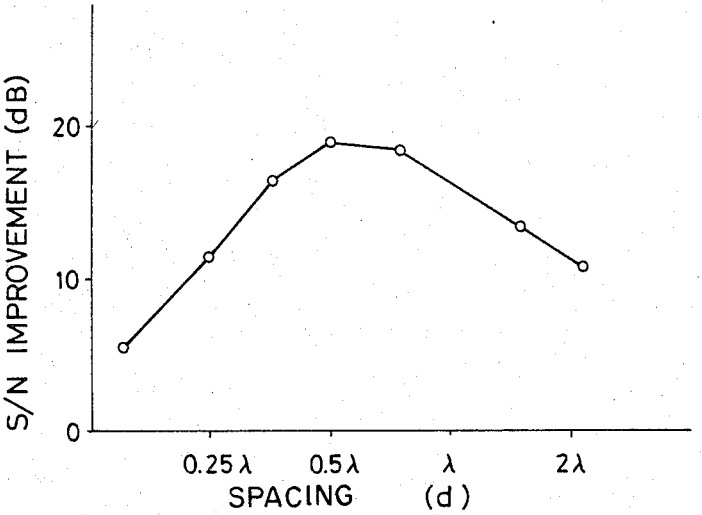
FIG. 23 is a graph showing the relation between the microphone element spacing d and the SN ratio improvement according to the arrangement of FIG. 21A.

The SN ratio improvement of this apparatus, with the microphone element spacing d changed in the arrangement of FIG. 21A, was measured in connection with five different experimental conditions of each of the noise arriving directions $\theta_{N1}$ and $\theta_{N2}$ and the desired signal arriving direction $\theta_s$ and the measured five values were averaged for each value of the microphone element spacing d. The mean measured values are shown in FIG. 23. In FIG. 23 the unit λ of the microphone element spacing d is the wavelength of the highest frequency (3000 Hz) in the frequency band (300 to 3000 Hz) employed. As will be seen from FIG. 23, when the microphone element spacing d is in the range of 0.3λ to λ, the SN ratio improvement is marked and, in particular, the spacing d in the vicinity of λ/2 produces the greatest SN ratio improvement.

Similarly, the SN ratio with each of the arrangements of FIGS. 21B, 21C and 21D was measured, with the radius $d_1$ changed, under the conditions shown in FIG. 22. The measured values obtained under three different conditions of each of the noise arriving directions $\theta_{N1}$ and $\theta_{N2}$ and the desired signal arriving direction $\theta_s$ were averaged for each value of the radius $d_1$. The mean measured values are shown in FIG. 24, in which curves 85, 86 and 87 correspond to the arrangements of FIGS. 21B, C and D, respectively.

Figure 24:
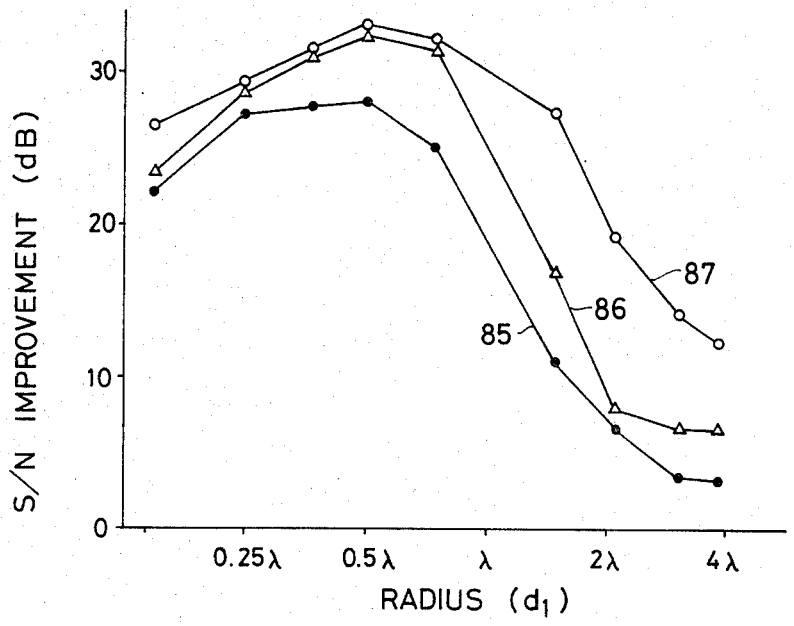
FIG. 24 is a graph showing the relation between the radius $d_1$ of a circle of arrangement of the microphone elements and the SN ratio improvement.

It appears from FIG. 24 that the SN ratio improvement in the case of using four microphone elements (corresponding to the curves 86 and 87) is more excellent than in the case of employing three microphone elements (corresponding to the curve 85). Further, as will be seen from comparison between FIGS. 23 and 24, the two-dimensional arrangement (FIGS. 21B, 21C and 21D) produces more excellent SN ratio improvement than does the one-dimensional arrangement (FIG. 21A). As revealed by these results, the performance of the microphone-array apparatus will be raised by increasing the number of microphone elements used and the number of dimensions of the arrangement. In practice, however, it is necessary to select the number of microphone elements used and the number of dimensions of the arrangement in accordance with the scale of the overall system, taking into account the degree of performance improvement, costs and so forth.

Furthermore, it will be appreciated that, in any of the arrangements, when the radius $d_1$ is in the range of 0.16λ to λ, the SN ratio improvement is high and, in particular, when the radius $d_1$ is in the vicinity of 0.5λ, the SN ratio improvement becomes the greatest. When the same number of microphone elements are used, the arrangement of FIG. 21D with a microphone element disposed at the center and the arrangement of FIG. 21C with no such a microphone element at the center produce substantially the same SN ratio improvement.

Figure 21E:
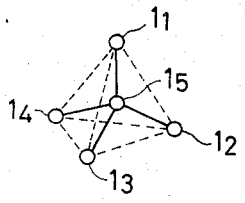
Figure 25:
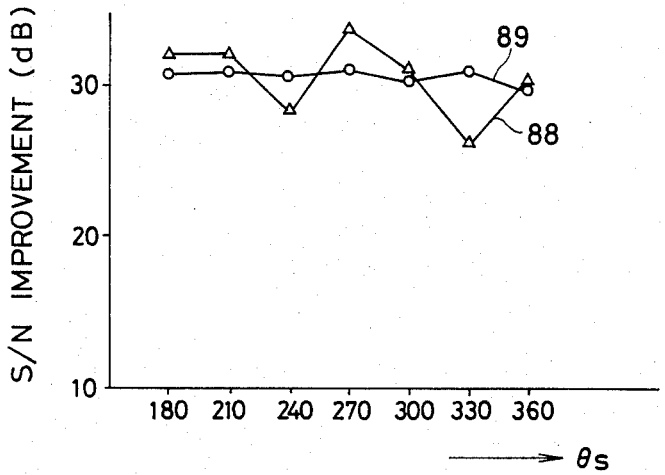
FIG. 25 is a graph showing the relation between the direction $\theta_s$ of arrival of the desired signal and the SN ratio improvement.

Moreover, the SN ratio improvements of the arrangements of FIGS. 21C and 21D were measured under the conditions of FIG. 22 in which $d_1=0.5\lambda$, $\theta_{N1}=43°$ and $\theta_{N2}=110°$ and the desired signal arriving direction $\theta_s$ was changed from 180° to 360° by steps of 30°. The measured results are shown in FIG. 25, in which curves 88 and 89 correspond to the arrangements of FIGS. 21C and 21D, respectively. FIG. 25 indicates that if the same number of microphone elements are used, the SN ratio improvement varies as great as 8 dB with the variation in the desired signal arriving direction $\theta_s$ in the case where the microphone elements are disposed only on the circumference of the circle, but that the arrangement with one of the microphone elements being disposed at the center of the circle produces a substantially constant SN ratio improvement regardless of the changes in the desired signal arriving direction $\theta_s$, and hence this arrangement is preferable. In the case of a three-dimensional arrangement, the microphone elements $\mathbf{1}_1$ to $\mathbf{1}_5$ are disposed preferably at respective vertexes and the center of a triangular pyramid as shown in FIG. 21E, for instance.

Figure 26:
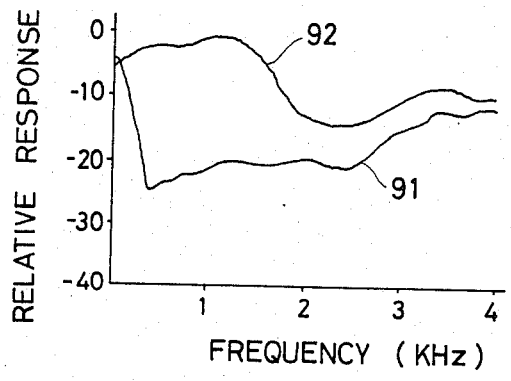
FIG. 26 is a graph showing experimental results of the apparatus which does not perform the FD signal level control.

Next, a description will be given of the results of experiments conducted for confirming the effectiveness of this system. The experiments were conducted in a room with a 0.4 sec reverberation time and under such conditions as shown in FIG. 13. The loudspeakers 64 and 65 were placed at distances $r_1=50$ cm and $r_2=50$ cm, respectively, from the center of the arrangement of the four microphone elements. The radius of the circumference on which the microphone elements were disposed was 8.5 cm (0.8λ). From the loudspeaker 65 was generated, as the desired signal, a 300 to 3000 Hz band-limited voice signal, and from the loudspeaker 64 was generated, as the noise, a 300 to 3000 Hz band-limited white noise. For the determination of the weighting value h, the output of the loudspeaker 65 was temporarily stopped and only the noise was received. The values of $\tau_1$ to $\tau_N$ dependent upon the position of the loudspeaker 65 were preset. The arrangement of the apparatus was the digital one shown in FIG. 4, and the sampling frequencies of the A/D conversion part 13 and the D/A converter 14 were selected to be 8 KHz. The delay time of each delay element in the delay parts 2 and 7 was selected to be 125 μsec, and the number of taps M for the microphone outputs was eight. FIG. 26 shows the frequency responses, to the noise and the desired signal, of the apparatus using the weighting value h thus obtained. From FIG. 26 it is seen that the response to the noise from the loudspeaker 64 (corresponding to the curve 91) is lower than the response to the desired signal from the loudspeaker 65 (corresponding to the curve 92) by 20 dB in the low-frequency range and by 7 to 8 dB in the high-frequency range, too. This indicates the intended effect of the present invention of extracting the desired signal while reducing the noise.

As is apparent from FIG. 26, however, the frequency response to the desired signal of this apparatus is lowered in the high-frequency range and hence is not flat.

Figure 27:
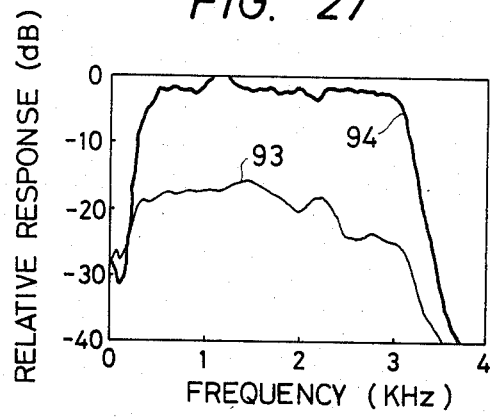
FIG. 27 is a graph showing the experimental results of the apparatus which performs the FD signal level control.

Further, under the same conditions as those for the above experiment except that the number of delay taps $M=16$, experiments were conducted on a digitally implemented apparatus of FIG. 17 which has the FD signal level control function. The experimental results are shown in FIG. 27. The control was made using the measure $D_1(A^2)$ and the threshold value $\hat{D}_1=0.1$. The frequency responses to the noise from the loudspeaker 64 and the desired signal from the loudspeaker 65 are indicated by curves 93 and 94, respectively. It is evident from FIG. 27 that as compared with the response to the desired signal, the response to the noise is lower by more than about 15 dB over the entire frequency range, and that the frequency response to the desired signal is almost flat.

Figure 28:
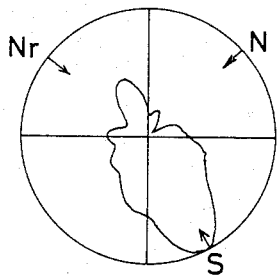
FIG. 28 is a diagram showing the directivity pattern of the apparatus of the present invention obtained as the experimental result.

FIG. 28 shows the directivity pattern of the microphone-array apparatus obtained by the abovesaid experiment. From FIG. 28 it will be appreciated that such a directivity pattern is formed that the response is sufficiently low in the direction (N) of the noise source and low in the direction (Nr) of arrival of a first reflected sound (i.e. an echo) from a concrete wall, too, but the response is sufficiently high in the direction (S) of arrival of the desired signal.

From the above results the effectiveness of the noise reducing function and the effectiveness of the FD signal level control by the present invention have been ascertained experimentally.

In the foregoing, it is also possible to combine the delay parts 2 and 7 into one. It is desirable that the number of delay elements 11 used in the delay parts 2 and 7 be large, and the overall delay time by the series-connected delay elements is selected longer than the sound wave propagation time between the remotest ones of the microphone elements $\mathbf{1}_1$ to $\mathbf{1}_N$. In the case where it is possible to assume that the arrival time of the desired signal at the respective microphone elements $\mathbf{1}_1$ to $\mathbf{1}_N$ is substantially the same, the FD signal delay part 6 can be omitted.

As has been described in the foregoing, according to the present invention, the signal received by the microphone array is applied to a delay circuit and then subjected to weighted summation to obtain the output, and as the information for the determination of the weighting value are used only the desired signal arriving time differences among the microphone elements and the noise received by the microphone elements during the silent period of the desired signal. Accordingly, even if the direction of the noise and the property of the desired signal are unknown, and even if the desired signal source and the noise sources shift, it is possible to reduce the noise component and extract the desired signal by adaptively modifying the weighting value during a newly detected silent period of the desired signal. Further, it has also been ascertained experimentally that the present invention does not call for the assumption of the plane wave property of sound waves, which has been required in the conventional array microphone theory, and that the present invention produces a sufficient noise reducing effect with a microphone arrangement scale of ten-odd centimeters at most.

As described in the foregoing, in the microphone-array apparatus which performs an adaptive operation through using the FD signal, by the addition thereto of the function of properly controlling the FD signal level, that is, by controlling the FD signal level on the optimization principle that minimizes the output noise power level under the condition that the degradation of the frequency response to the desired signal is made smaller than a predetermined value, it is possible to settle such problems that the desired signal is greatly distorted or the SN ratio cannot be improved sufficiently, depending on the actual value of the noise level. Also it is possible to select a desired one of various combinations of the desired signal frequency response and the SN ratio improvement by the apparatus of the present invention. This permits, under various noise environments, the operation of the adaptive microphone-array apparatus to meet varied requirements, for achieving a considerable improvement of the SN ratio while permitting a certain degree of degradation of the desired signal, for minimizing the degradation of the desired signal at the sacrifice of the SN ratio, and so forth.

It will be apparent that many modifications and variations may be effected without departing from the scope of the novel concepts of the present invention.

What is claimed is:

1. A microphone-array apparatus comprising:

a plurality of microphone elements for receiving acoustic signals;

first delay means connected to the microphone elements, for delaying their output signals for different periods of time to output a plurality of delayed signals;

first weighted summation means connected to the first delay means, for weighting and summing up the plurality of delayed output signals to extract desired signals from the signals produced by the microphone elements while at the same time reducing unnecessary signals contained in the received acoustic signals;

fictitious desired signal generating means for electrically generating a fictitious desired signal;

first adding means for adding the fictitious desired signal from the fictitious desired signal generating means and the output signal of each of the microphone elements;

second delay means connected to the first adding means, for delaying the added signals therefrom in the same manner as in the first delay means; and weighting value determining means connected to the second delay means and the fictitious desired signal generating means, for computing weighting values of the first weighted summation means in a manner to minimize a predetermined measure through using the plurality of delayed output signals from the second delay means and the fictitious desired signal.

2. A microphone-array apparatus according to claim 1, which includes third delay means inserted between the fictitious desired signal generating means and the first adding means, for delaying the fictitious desired signal for periods of time respectively corresponding to the time differences of arrival of the desired signal at the microphone elements.

3. A microphone-array apparatus according to claim 2, wherein the weighting value determining means obtains the weighting values by computing the correlation among the plurality of delayed outputs from the second delay means and the correlation between the plurality of delayed outputs and the fictitious desired signal.

4. A microphone-array apparatus according to claim 2, wherein the weighting value determining means comprises second weighted summation means for weighting and summing up the plurality of delayed outputs from the second delay means, second adding means for obtaining the difference between the output of the second weighted summation means and the fictitious desired signal to produce an error signal, and a recursive weighting value computing means for computing the weighting values by a recursive algorithm from the correlation between the error signal and the outputs of the second delay means.

5. A microphone-array apparatus according to claim 3, which includes degradation detecting means for obtaining the degradation of the frequency response of the apparatus to the desired signal, comparing means for comparing the detected degradation and a threshold value, and level control means for controlling the level of the fictitious desired signal to be generated from the fictitious desired signal generating means in accordance with the comparison result.

6. A microphone-array apparatus according to claim 5, wherein the degradation detecting means comprises fourth delay means identical in construction with the second delay means and supplied with the outputs of the third delay means, second weighted summation means supplied with each delay output of the fourth delay means and the weighting values from the weighting value determining means, for weighting and summing up the outputs of the fourth delay means, second adding means for detecting the difference between the output of the second weighted summation means and the fictitious desired signal to obtain an error signal, and degradation computing means for computing, from the error signal, the degradation of the frequency response of the apparatus to the desired signal.

7. A microphone-array apparatus according to claim 6, wherein the degradation computing means comprises square integrating means for square-integrating the error signal, and dividing means for dividing the square-signal, integrated output by the power of the fictitious desired signal.

8. A microphone-array apparatus according to claim 4, which includes degradation detecting means for obtaining the degradation of the frequency response in the direction of arrival of the desired signal, comparing means for comparing the detected degradation and a threshold value, and level control means for controlling the level of the fictitious desired signal from the fictitious desired signal generating means in accordance with the comparison result.

9. A microphone-array apparatus according to claim 8, the degradation detecting means comprises square integrating means for square-integrating the error signal from the second adding means, and dividing means for dividing the output of the square integrating means by the power of the fictitious desired signal to output the degradation.

10. A microphone-array apparatus according to claim 8, wherein the degradation detecting means comprises fourth delay means indentical in construction with the second delay means and supplied with the output of the third delay means, third weighted summation means supplied with each output of the fourth delay means and the weighting values from the weighting value determining means, for weighting and summing up the outputs of the fourth delay means, third adding means for detecting the difference between the output of the third weighted summation means and the fictitious desired signal to obtain a second error signal, and degradation computing means for computing the degradation of the frequency response of the apparatus to the desired signal from the second error signal.

11. A microphone-array apparatus according to claim 10, wherein the degradation computing means comprises square integrating means for square-integrating the second error signal, and dividing means for dividing the square-integrated output by the power of the fictitious desired signal.

12. A microphone-array apparatus according to any one of claims 1, 2, 3, 4, 5, or 8, wherein the fictitious desired signal generating means is means for generating a white noise signal limited to substantially the same frequency band as a desired frequency band.

13. A microphone-array apparatus according to claim 12, wherein the white noise signal generating means is memory means which has stored therein a white noise signal waveform and outputs the white noise signal by reading out the stored waveform.

14. A microphone-array apparatus according to claim 12, wherein the fictitious desired signal generating means generates a colored noise signal produced by giving a weight to the band-limited white noise signal according to its contribution to articulation.

15. A microphone-array apparatus according to any one of claims 1, 2, 3, 4, 5 or 8, which includes manual command means for starting the operation of the weighting value determining means.

16. A microphone-array apparatus according to any one of claims 2, 3, 4, 5 or 8, which includes time difference detecting means for detecting, on the basis of the output of one of the microphone elements, the delay time of each of the other microphone elements in the state that the time difference detecting means is essentially supplied with only the desired signal from the microphone element, and means for setting each delay time of the third delay means by the detected output of the time difference detecting means.

17. A microphone-array apparatus according to any one of claims 1, 3, 4, 5 or 8, which includes a loudspeaker provided at such a position where sounds radiated therefrom may be received by the microphone elements directly or indirectly, and a test signal generating means for supplying a test signal to the loudspeaker.

18. A microphone-array apparatus according to any one of claims 1, 2, 3, 4, 5 or 8, wherein the microphone elements are aligned at equal intervals, and wherein the microphone element spacing is in the range of 0.3 to 1 of the shortest wavelength in the desired frequency band.

19. A microphone-array apparatus according to any one of claims 1, 2, 3, 4, 5 or 8, wherein the microphone elements are disposed on substantially the same circular circumference at nearly equal intervals.

20. A microphone-array apparatus according to claim 19, wherein one microphone element is disposed substantially at the center of the circle of arrangement of the microphone elements.

21. A microphone-array apparatus according to claim 19, wherein the radius of the circle of arrangement of the microphone elements is substantially in the range of 0.16 to 1 of the shortest wavelength in the desired frequency band.

22. A microphone-array apparatus according to claim 5, wherein the degradation detecting means comprises fourth delay means identical in construction with the second delay means and supplied with the output of the third delay means, second weighted summation means supplied with the delayed output of the fourth delay means and the weighting values from the weighting value determining means, for performing weighted summation, first multiplying means for multiplying the output of the second weighted summation means and the fictitious desired signal, first square integrating means for square-integrating the output of the first multiplying means, second square integrating means for square-integrating the output of the second weighted summation means, second multiplying means for multiplying the power of the fictitious desired signal and the output of the second square integrating means, and dividing means for dividing the output of the first multiplying means by the output of the second multiplying means.

23. A microphone-array apparatus according to any one of claims 1, 3, 4, 5 or 8, which includes a loudspeaker placed at the position where sounds radiated therefrom may be received by the microphone elements directly or indirectly, send/receive state deciding means supplied with a receiving channel signal to the loudspeaker and the microphone element output signal, for deciding from the levels of the both signals, the state in which the desired signal level is substantially zero and the state in which the receiving channel signal is substantially zero, and means for causing the weighting value determining means to determine the weighting value when the desired signal level is decided to be zero.

24. A microphone-array apparatus according to claim 20, wherein the radius of the circle of arrangement of the microphone elements is substantially in the range of 0.16 to 1 of the shortest wavelength in the desired frequency band.

25. A method for receiving an acoustic signal with a plurality of microphone elements and electrically processing the outputs of the microphone elements to produce a desired signal having reduced therefrom undesired signals, the method comprising:

a step of receiving the undesired signals by the plurality of microphone elements during a silent period of the desired signal;

a step of adding the respective outputs from the plurality of the microphone elements and an electrically generated fictitious desired signal;

a first delay step for subjecting each of the added outputs to delays of different time period to produce a plurality of delayed outputs for each of the added outputs;

an arithmetic operation step for computing weighting values from the outputs of the first delay step and the fictitious desired signal so as to minimize a predetermined measure;

a second delay step for delaying the outputs of the respective microphone elements in the presence of the desired signal in a manner similar to the first delay step; and a weighted summation step for weighting and summing up the outputs of the second delay step with the weighting values obtained in the arithmetic operation step.

26. A method according to claim 25 which further comprises: a level controlling step for computing a degradation of the frequency response to the desired signal through using the weighting values obtained in the arithmetic operation step, comparing the degradation with a predetermined threshold value and controlling the level of the fictitious desired signal; and a repetition step for repeating the sequence including the step for adding, the first delay step, the arithmetic operation step and the level controlling step until the degradation falls within a predetermined range of the threshold value.

27. A method according to claim 25, wherein the arithmetic operation step is an operation using a recursive algorithm; the method further comprising computing the degradation of the frequency response to the desired signal through using weighting values obtained at each recursive step of the recursive algorithm, comparing the current degradation with a predetermined threshold value, and controlling the level of the fictitious desired signal.

28. A method according to any one of claims 25, 26, or 27, wherein the silent period is selected to be a time period before beginning of the generation of the desired signal.

29. A method according to any one of claims 25, 26, or 27 wherein the silent period is selected to be a silent interval between successive occurrences of the desired signal.

* * * * *